US006004129A

United States Patent [19]

Carbone et al.

[11] Patent Number: 6,004,129

[45] Date of Patent: Dec. 21, 1999

[54] BURNER HOUSING AND PLENUM CONFIGURATION FOR GAS-FIRED BURNERS

[75] Inventors: Philip C. Carbone, North Reading; Karen R. Benedek, Winchester; Michael J. Farina, Waltham; Stephan E. Schmidt, Winchester, all of Mass.

[73] Assignee: Gas Research Institute, Chicago, Ill.

[21] Appl. No.: 09/243,272

[22] Filed: Feb. 2, 1999

Related U.S. Application Data

[63] Continuation-in-part of application No. 08/912,483, Aug. 18, 1997.

[60] Provisional application No. 60/024,170, Aug. 19, 1996.

[51] Int. Cl.[6] ..... F23D 14/02

[52] U.S. Cl. ..... 431/354; 431/326

[58] Field of Search ..... 431/354, 326, 431/328, 7, 10, 353, 351; 126/91 R

[56] References Cited

U.S. PATENT DOCUMENTS

| | | | |
|---|---|---|---|
| 2,849,220 | 8/1958 | Duffy et al. . | |
| 3,170,504 | 2/1965 | Lanning . | |
| 3,326,201 | 6/1967 | Murray . | |
| 3,736,095 | 5/1973 | Leatherby | 431/328 |
| 4,014,316 | 3/1977 | Jones et al. . | |
| 4,063,873 | 12/1977 | Naito . | |
| 4,154,861 | 5/1979 | Smith . | |
| 4,187,835 | 2/1980 | Finney . | |
| 4,230,443 | 10/1980 | Berg et al. | 431/328 |
| 4,355,973 | 10/1982 | Bailey . | |
| 4,421,476 | 12/1983 | Gulden et al. | 431/328 |
| 4,424,793 | 1/1984 | Cooperrider . | |
| 4,674,973 | 6/1987 | Wright . | |
| 4,676,737 | 6/1987 | Suzuki et al. . | |
| 4,830,600 | 5/1989 | VerShaw et al. . | |
| 4,869,230 | 9/1989 | Fletcher et al. . | |
| 5,057,007 | 10/1991 | Andringa et al. . | |
| 5,062,788 | 11/1991 | Best | 431/326 |
| 5,361,750 | 11/1994 | Seel et al. . | |
| 5,429,112 | 7/1995 | Rozzi . | |
| 5,439,372 | 8/1995 | Duret et al. | 431/7 |

*Primary Examiner*—Ira S. Lazarus
*Assistant Examiner*—Sara Clarke
*Attorney, Agent, or Firm*—Pauley Peterson Kinne & Fejer

[57] ABSTRACT

A burner apparatus for gas-fired appliances, such as gas furnaces. The burner apparatus includes an improved flame holder structure for controlling the shape and contour of the flame, and burner housing and plenum configurations for enhancing the characteristics of the flame.

13 Claims, 22 Drawing Sheets

| | # OF HOLES | RADIUS | POSITION |
|---|---|---|---|
| 1 | 1 | 0.000 | 0 |
| 2 | 6 | 0.085 | 0 |
| 3 | 12 | 0.142 | 0 |
| 4 | 12 | 0.198 | 0 |
| 5 | 12 | 0.255 | 0 |
| 6 | 12 | 0.287 | 9.83 |
| 7 | 12 | 0.287 | 350.17 |
| 8 | 12 | 0.312 | 0 |
| 9 | 12 | 0.343 | 8.21 |
| 10 | 12 | 0.343 | 351.79 |
| 11 | 12 | 0.368 | 0 |
| 12 | 12 | 0.425 | 0 |
| 13 | 12 | 0.456 | 6.18 |
| 14 | 12 | 0.456 | 353.82 |
| 15 | 12 | 0.482 | 0 |
| 16 | 12 | 0.512 | 5.50 |
| 17 | 12 | 0.512 | 354.50 |
| 18 | 12 | 0.538 | 0 |
| 19 | 24 | 0.595 | 0 |
| 20 | 24 | 0.625 | 4.50 |
| 21 | 24 | 0.625 | 355.50 |
| 22 | 24 | 0.651 | 0 |
| 23 | 24 | 0.682 | 4.13 |
| 24 | 24 | 0.682 | 355.87 |
| 25 | 24 | 0.708 | 0 |
| 26 | 48 | 0.772 | 0 |

TOTAL NUMBER OF PORTS = 415
PORT DIAMETER = 0.040"
TOTAL OPEN AREA = 0.522 sq.in.
PORT LOADING @ 25kBtu/hr = 48kBtu/hr-sq.in.

| | # OF HOLES | RADIUS | POSITION |
|---|---|---|---|
| 1 | 1 | 0.000 | 0 |
| 2 | 6 | 0.188 | 0 |
| 3 | 12 | 0.313 | 15 |
| 4 | 12 | 0.438 | 0 |
| 5 | 24 | 0.615 | 0 |
| 6 | 24 | 0.729 | 7.5 |

TOTAL NUMBER OF PORTS = 79
PORT DIAMETER = 0.081"
TOTAL OPEN AREA = 0.407 sq.in.

BURNER HOUSING AND PLENUM CONFIGURATION FOR GAS-FIRED BURNERS

CROSS REFERENCE TO RELATED APPLICATIONS

This application is a continuation-in-part application of pending U.S. patent application, U.S. Ser. No. 08/912,483 filed Aug. 18 1997, which application in turn depends from Provisional Application Ser. No. 60/024,170, filed Aug. 19 1996. The co-pending parent patent application is hereby incorporated by reference herein and is made a part hereof, including but not limited to those portions which specifically appear hereinafter.

BACKGROUND OF THE INVENTION

Field of the Invention

The present invention relates to gas burner apparatus, and in particular, to burner housings and plenum configurations for use with gas-fired burners, such as may be used in gas furnaces for the thermal conditioning of residential or other occupied spaces.

Gas burners, and burner housings, plenums and heat exchangers exist in a variety of configurations, depending upon the type of burner function contemplated. For example, there are gas burners and housings which are designed for radiant heating operation, in which the gas flame is contemplated to more or less reside on the surface of the burner plate or flame holder. Other burner/housing/plenum configurations are designed to provide for controlled flow of the gas and/or combustion air which is being projected through the burner plate, and the flame is contemplated as being positioned in a stable manner, extending for some distance from the burner plate or flame holder.

Generally, regardless of the particular type or intended function of the burner apparatus, all have certain common goals in their design. These include: 1) quiet operation; 2) a stable flame; 3) efficient transfer of the heat generated to the desired destination, whether it is a particular surface, as in a heat exchanger, or directly to a mass of air or other fluid; and 4) complete combustion.

One example of a prior art burner apparatus is disclosed in Naito, U.S. Pat. No. 4,063,873. The Naito '873 reference discloses an infrared gas burner plate, having a plurality of diamond-shaped depressions and projections. A number of apertures for combustion air and gas are distributed throughout the inclined surfaces of the depressions and projections. All of the apertures are the ends of parallel passageways through the burner plate, and each aperture has a diameter which is substantially less than the length of its associated passageway.

It would be desirable to provide a burner housing and plenum configuration which is configured to help maintain a stable flame, for blue flame combustion operation, over a wide range of firing rates and fuel/air ratios.

An additional desirable feature would be to provide a burner housing and plenum configuration which helps promote a quieter, improved flame geometry, with reduced flame spread and reduced tendency of the flame to impinge upon the side walls of heat exchanger structures, thereby lowering heat exchanger temperature and reducing CO generation.

It would additionally be desirable to provide such a burner apparatus as a fully premixed burner apparatus.

Still another object of the invention would be to provide such a burner apparatus which would be suitable for use in gas furnace environments.

It would also be desirable to provide such a burner apparatus as a partially premixed burner apparatus. In particular, it would be desirable to provide a burner housing which is relatively easily adaptable for use in a fully premixed or a partially premixed burner configuration, as may be desired in a particular application. Such adaptability of a single housing design can desirably simplify manufacture, production and supply.

These and other objects of the invention will become apparent in light of the present specification, claims and drawings.

SUMMARY OF THE INVENTION

The present invention comprises a burner plenum, for use with a burner apparatus. The burner plenum is configured for receiving combustion air and gaseous fuel from a gaseous fuel manifold, which is then mixed for delivery to a desired location for ignition. Such ignition results in the production of a stabilized flame for providing heat to be transferred to a location remote from the burner apparatus.

The burner plenum comprises a plurality of side walls, defining an interior volume; an inlet plate, connected to the side walls of the burner plenum, at one end thereof, and having means for enabling injection of gaseous fuel from at least one gaseous fuel outlet into the interior volume of the burner plenum. The inlet plate further has means for enabling ambient air to be drawn into the interior volume of the burner plenum by a suction source downstream of the burner plenum into the interior volume of the burner plenum.

The inlet plate member further comprises a plate member; at least one gas inlet aperture disposed in the plate member, for receiving therethrough a jet of gaseous fuel being emitted from at least one gaseous outlet of a gaseous fuel manifold; and a plurality of air inlet apertures, substantially surrounding each at least one gas inlet aperture, so that ambient air is drawn, by a source of suction downstream of the burner plenum, through the plurality of air inlet apertures, into the burner plenum.

The side walls defining the interior volume of the burner plenum, further comprise an mixing region having a substantially constant width and a substantially constant thickness. A pressure recovery region, disposed downstream from the mixing region, has a substantially constant width and a substantially continuously increasing thickness. The side walls of the burner plenum defining the pressure recovery region are operably configured for association with a burner plate, for directing mixed gaseous fuel and combustion air to the burner plate.

In an embodiment, the burner plenum further comprises a baffle member, positioned within the pressure recovery region of the interior volume, for facilitating mixing of the gaseous fuel with the combustion air and subsequent distribution of the mixed gaseous fuel and combustion air across the width of the burner plenum, in turn, for facilitating distribution of the mixed fuel and air across a burner plate disposed in an outlet region of the burner plenum.

The present invention also comprises a heat exchanger apparatus, for use in association with a gaseous fuel-fired burner, for enabling the transfer of heat developed by the combustion of gaseous fuel, to a fluid to be heated.

In such an embodiment, the heat exchanger apparatus comprises a heat exchanger shell, configured for the passage therethrough of a fluid to be heated and at least one heat exchanger tube, operably positionable in juxtaposition to a gaseous fuel-fired burner. The heat exchanger tube receives a flame from a gaseous fuel-fired burner, and also receives and transmits therethrough the combustion products from such flame.

The at least one heat exchanger tube is preferably positioned within the heat exchanger shell so that a fluid to be heated is permitted to pass by and around it. The at least one heat exchanger tube may be configured to facilitate the transfer of heat from a flame and the combustion products thereof while precluding escape of combustion products into the fluid to be heated.

The at least one heat exchanger tube may further include means for facilitating transfer of heat therethrough while increasing velocity of the combustion products therethrough.

The heat exchanger tube comprises at least one inlet, disposed on an outer surface of the heat exchanger shell, connecting one end of the at least one heat exchanger tube to an outer surface of the heat exchanger shell, and at least one outlet, disposed on the outer surface of the heat exchanger shell, at a position substantially remote from the inlet, connecting another end of the at least one heat exchanger tube to the outer surface of the heat exchanger shell.

The heat exchanger tube may further comprise a first elongated, substantially straight section, having a substantially constant transverse cross-sectional configuration. The first elongated section substantially adjoins the at least one inlet. A second arcuate section adjoins the first section and the at least one outlet. This arcuate section has a transverse cross-sectional configuration which decreases in area, proceeding from the first elongated section to the at least one outlet.

In an embodiment of the invention, the first elongated section is positioned in an upstream position within the heat exchanger shell, relative to the second arcuate section. The second arcuate section is convexly curved toward the first elongated section.

The heat exchanger tube transverse cross-sectional configuration in each of the first and second sections preferably has a width, transverse to the flow of the fluid being heated around the heat exchanger tube, which is less than the length of the transverse cross-sectional configuration, in a direction substantially parallel to the flow of the fluid being heated around the heat exchanger tube. The heat exchanger tube transverse cross-sectional configuration may be substantially elliptical substantially along its length.

The means for facilitating heat transfer while increasing velocity of the combustion products comprises one or more indentations in the surface of the heat exchanger tube, in the second arcuate section, proximate an outlet region of the heat exchanger tube.

Another aspect of the invention relates to burner housings and assemblies and has, as a general object, the providing of improved burner housings and assemblies.

A more specific objective of this aspect of the invention is to overcome one or more of the problems described above.

The general object of this aspect of the invention can be attained, at least in part, through a specified burner housing, for use with a burner apparatus, configured to form a plenum for receiving combustion air and gaseous fuel, for mixing same for delivery to a desired location for ignition of the mixed gaseous fuel and combustion air, toward promoting the production of a stabilized flame for providing heat to be transferred to a location remote from the burner apparatus.

In accordance with one embodiment of the invention, such a burner housing includes a side wall, an inlet plate and a target plate. The side wall, at least in part, defines an interior volume. The inlet plate is connected to the side wall at one end thereof. The target plate is longitudinally spaced from the inlet plate and defines, within the interior volume, an introduction zone for the introduction of combustion air and gaseous fuel to the interior volume and, adjacent the introduction zone, a mixing zone for the mixing of the gaseous fuel and combustion air.

The inlet plate includes means for enabling injection of gaseous fuel into the introduction zone. The inlet plate further includes means for enabling ambient air to be drawn into the introduction zone by a suction source disposed downstream of the burner plenum. The target plate includes means for enabling passage of combustion air and gaseous fuel from the introduction zone into the mixing zone to form a combustible mixture of combustion air and gaseous fuel.

The invention further comprehends a burner assembly which includes a burner housing and a burner plate operably configured in association with the burner housing. The burner housing is configured to form a plenum for receiving combustion air and gaseous fuel, for mixing same for delivery to a desired location for ignition of the mixed gaseous fuel and combustion air, toward promoting the production of a stabilized flame for providing heat to be transferred to a location remote from the burner assembly. The burner housing includes a side wall, at least in part defining an interior volume. The burner housing also includes an inlet plate, connected to the side wall, at one end thereof. The burner housing still further includes a target plate, longitudinally spaced from the inlet plate, defining, within the interior volume, an introduction zone for the introduction of combustion air and gaseous fuel to the interior volume and, adjacent the introduction zone, a mixing zone for the mixing of the gaseous fuel and combustion air. The burner housing also includes a burner plate holding section adapted to hold the burner plate adjacent an end of the side wall opposite the inlet plate.

The inlet plate includes means for enabling injection of gaseous fuel into the introduction zone. The inlet plate further includes means for enabling ambient air to be drawn into the introduction zone by a suction source disposed downstream of the burner plenum. The target plate includes means for enabling passage of combustion air and gaseous fuel from the introduction zone into the mixing zone to form a combustible mixture of combustion air and gaseous fuel. The burner plate includes at least one flame holder region.

In accordance with one preferred embodiment of the invention, the side wall of the burner housing defining the mixing zone is operably configured, in association with a burner plate, for directing mixed gaseous fuel and combustion air to the at least one flame holder region.

The invention still further comprehends a burner housing, for use with a burner apparatus, configured to form a plenum for receiving combustion air and gaseous fuel, for mixing same for delivery to a desired location for ignition of the mixed gaseous fuel and combustion air, toward promoting the production of a stabilized flame for providing heat to be transferred to a location remote from the burner apparatus.

The burner housing is adapted to hold a burner plate and includes a side wall, at least in part defining an interior volume. The burner housing also includes an inlet plate, connected to the side wall, at one end thereof. The burner housing further includes a target plate, longitudinally spaced from the inlet plate, defining, within the interior volume, an introduction zone for the introduction of combustion air and gaseous fuel to the interior volume and, adjacent the introduction zone, a mixing zone for the mixing of the gaseous fuel and combustion air.

The inlet plate includes means for enabling injection of gaseous fuel into the introduction zone. The inlet plate further includes means for enabling ambient air to be drawn into the introduction zone by a suction source disposed downstream of the burner plenum. The target plate includes means for enabling passage of combustion air and gaseous fuel from the introduction zone into the mixing zone to form a combustible mixture of combustion air and gaseous fuel.

The burner housing is configured to selectively alternatively operate in a fully premixed mode of operation wherein substantially all combustion air is introduced through the introduction zone and in a partial premixed mode of operation wherein secondary combustion air is drawn into reaction contact with the mixed gaseous fuel and combustion air downstream of the burner plate.

Other objects and advantages will be apparent to those skilled in the art from the following detailed description taken in conjunction with the appended claims and drawings.

BRIEF DESCRIPTION OF THE DRAWINGS

These and other objects of this invention will be better understood from the following detailed description taken in conjunction with the drawings wherein:

FIG. 17 X is an end elevation of the heat exchanger of FIG. 17, similar to FIG. 14, but now showing certain dimensions thereof.

DESCRIPTION OF PREFERRED EMBODIMENTS

Figure 1:
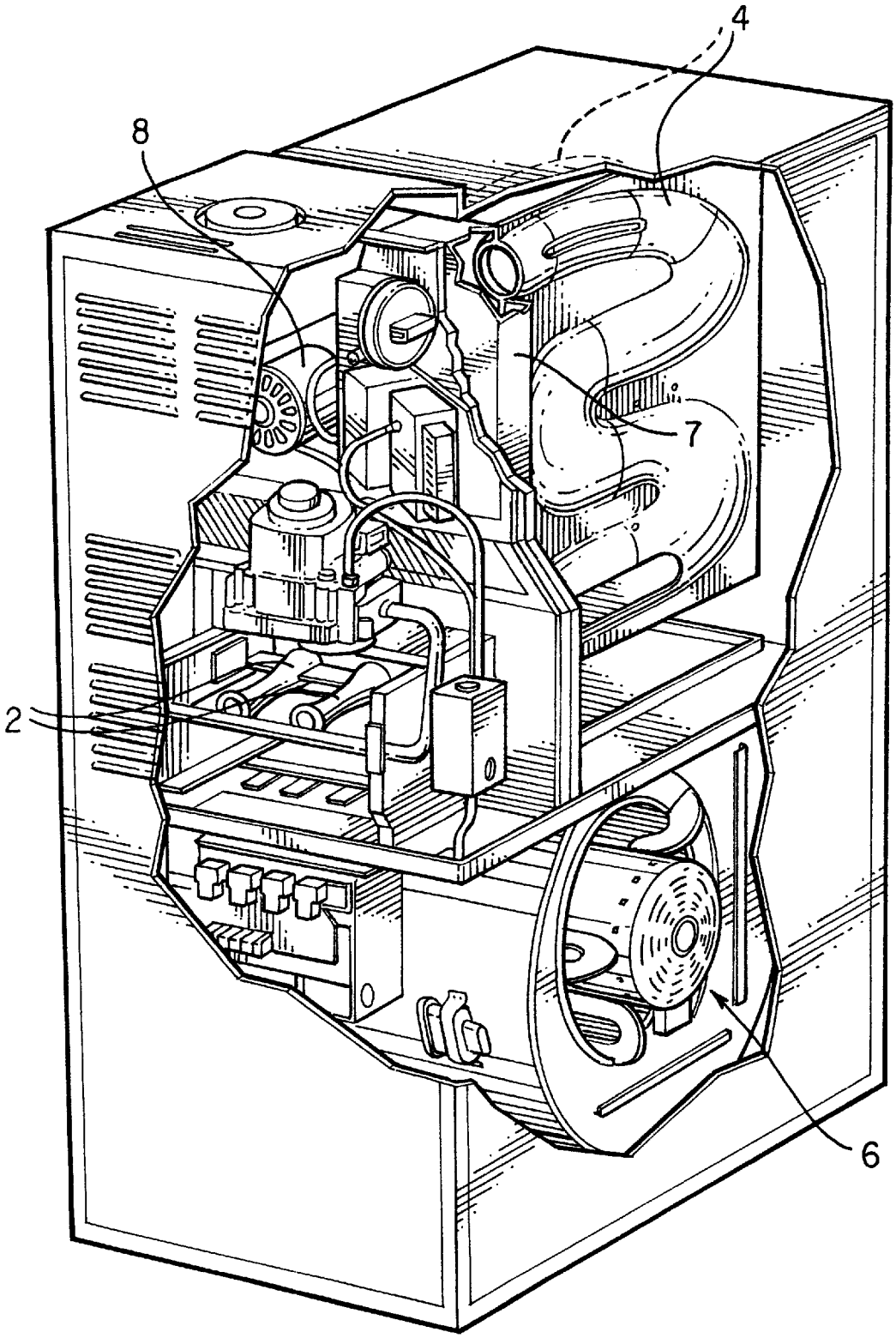
FIG. 1 PRIOR ART
FIG. 1 is a perspective view of a prior art warm air furnace, showing the general burner plenum and heat exchanger configurations.

While this invention is susceptible of embodiment in many different forms, there is shown in the drawings and will be described herein in detail, several embodiments, with the understanding that the present disclosure is to be considered as an exemplification of the principles of the invention and is not intended to limit the invention to the embodiments illustrated.

FIG. 1 illustrates a prior art conventional warm air furnace, having a pair of in-shot burners 2, which fire into a pair of serpentine heat exchangers 4. The heat exchangers typically will have 2, 3 or more turns, and may have a decreasing interior cross-sectional area. The air to be heated passes upwardly around the heat exchangers, propelled by circulation fan 6. After passing through the heat exchangers, the combustion gases are collected in a collection box 7, being drawn by an inducer fan 8, and on to a flue or chimney, in a manner well known in the art.

The present invention is directed to burner apparatus, in particular fully premixed, gas-fired, induced draft burners, configured to fire into tubular or clamshell-type heat exchangers, such as are found in residential warm air furnaces.

Figure 2:
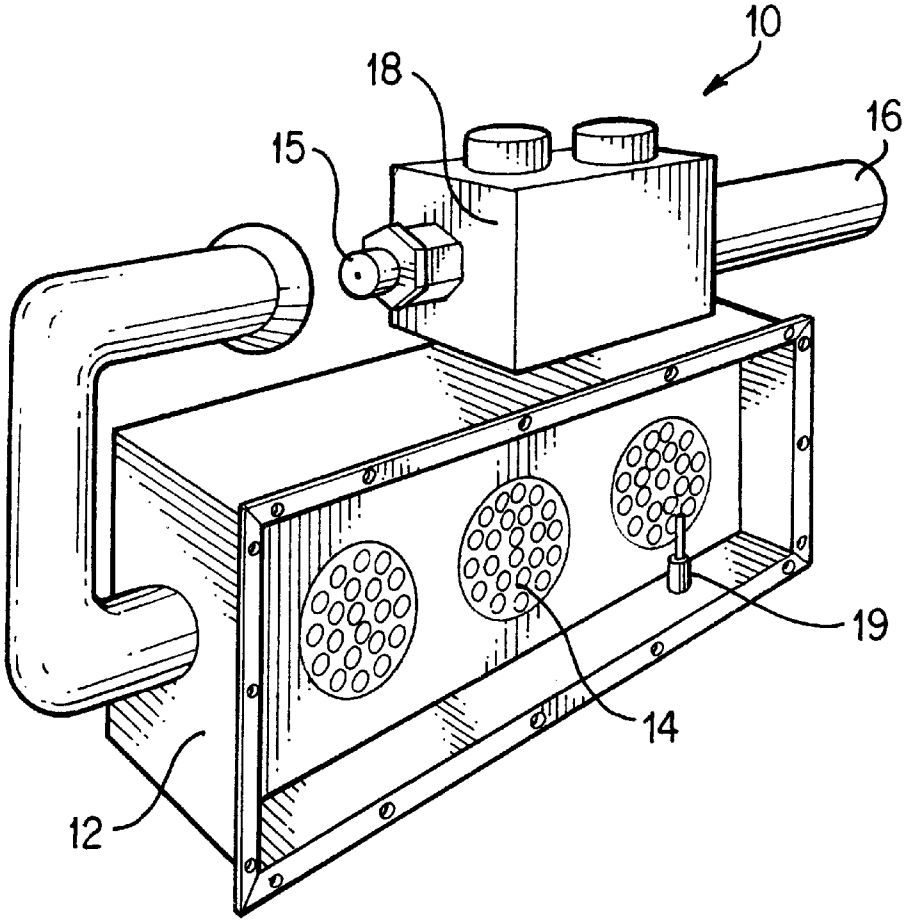
FIG. 2 is a perspective view of a burner apparatus according to one embodiment of the invention.

FIG. 2 illustrates, according to one embodiment of the present invention, a gas burner/plenum 10, in accordance with the principles of the present invention, as might be used in a gas furnace for a domestic residence or other occupied space. Gas burner/plenum 10 is of the premixed gas/air variety, in which the fuel gas and all of the intended combustion air is premixed in an inlet plenum 12, prior to ignition of the gas and air. Burner/plenum 10 includes a plurality of perforated flame holders 14 which are each fed by gas spud 15.

In an embodiment of the invention, gas is delivered to burner/plenum 10 by inlet 16, and regulated through a gas valve 18, which may be a conventional gas valve, a stepped valve or even a modulating gas valve. In order to enable control of the combustion process, a flame sensor 19 (FIGS. 2 and 3) is provided which senses the stoichiometry of the flame, as a function of the degree of ionization in the flame. While conventional control methods for regulating the operation of the valve may be used, one suitable control method for regulating the operation of a gas burner may be found in copending patent application U.S. Ser. No. 08/747,777, filed Nov. 13 1996, the complete disclosure of which is incorporated herein by reference.

Figure 3:
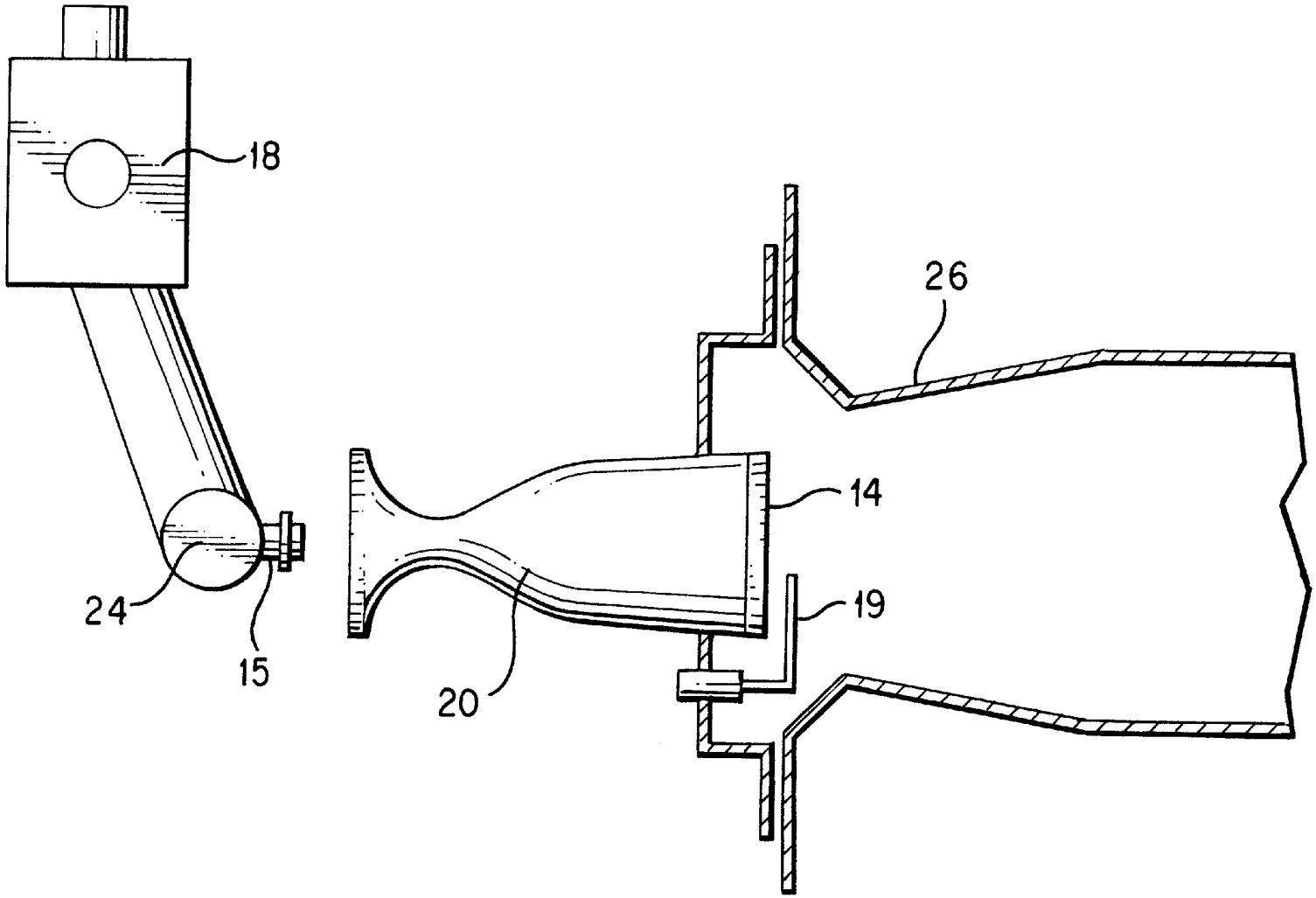
FIG. 3 is a schematic view of a burner apparatus system, suitable for use in one embodiment of the present invention.

FIG. 3 illustrates schematically an alternative burner configuration, in which one or more inshot burners 20, each having a flame holder 14, which will be supplied gas and combustion air by corresponding one or more respective gas spuds 15, each of which is associated with a manifold 24. Each of the burners 20 opens to a heat exchanger 26, for delivery of the heat generated by the combustion process.

Figure 4:
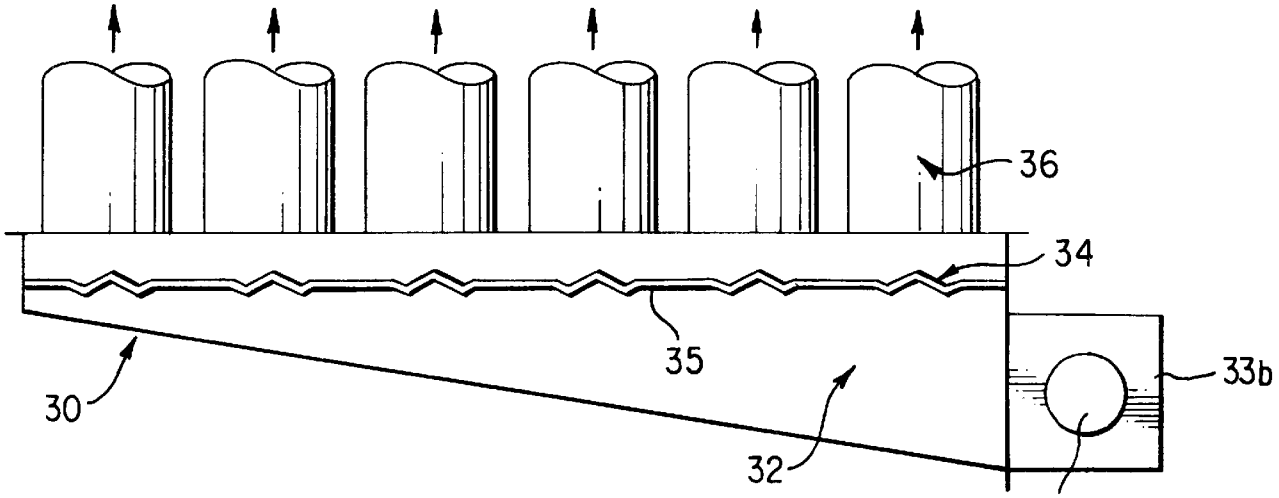
FIG. 4 is a top plan view of one embodiment of a burner apparatus incorporating a burner plate of the present invention, showing a contemplated inlet plenum configuration.
Figure 5:
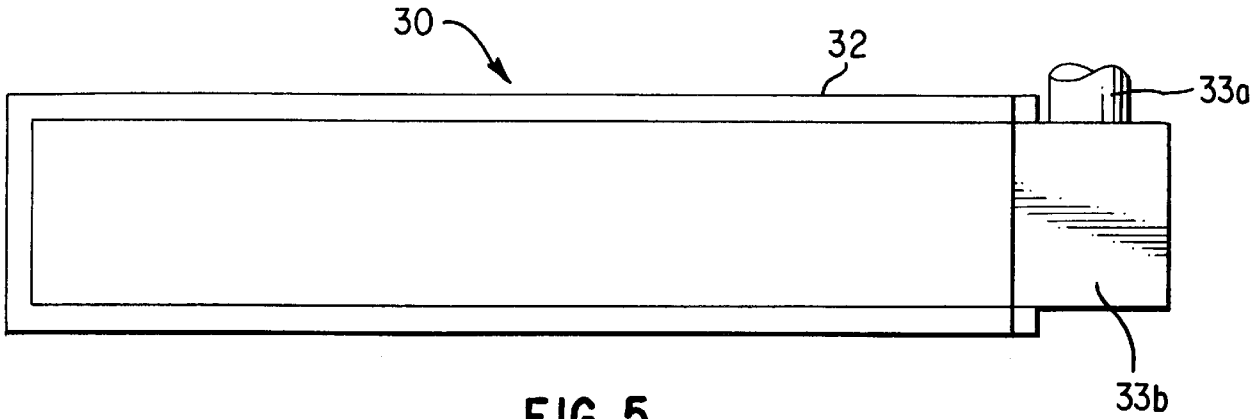
FIG. 5 is a front view of the burner apparatus and inlet plenum configuration, according to the embodiment of FIG. 4.

FIGS. 4 and 5 illustrate a burner/plenum configuration 30, having a side feed plenum 32 with a gas and air supply conduit 33*a* and an associated distribution box 33*b*. Plenum 32 may have a trapezoidal cross-sectional plan configuration, as indicated in FIG. 4. Burner plate (flame holder) 34 is positioned in the side of plenum 32 which opens onto the furnace heat exchanger 36. Baffle plate 35 is positioned immediately upstream of burner plate 34. After passing through the furnace heat exchanger 36, the combustion products (signified by the arrows 36*a*) are directed to a suitable flue or chimney out of the occupied space.

Figure 5A:
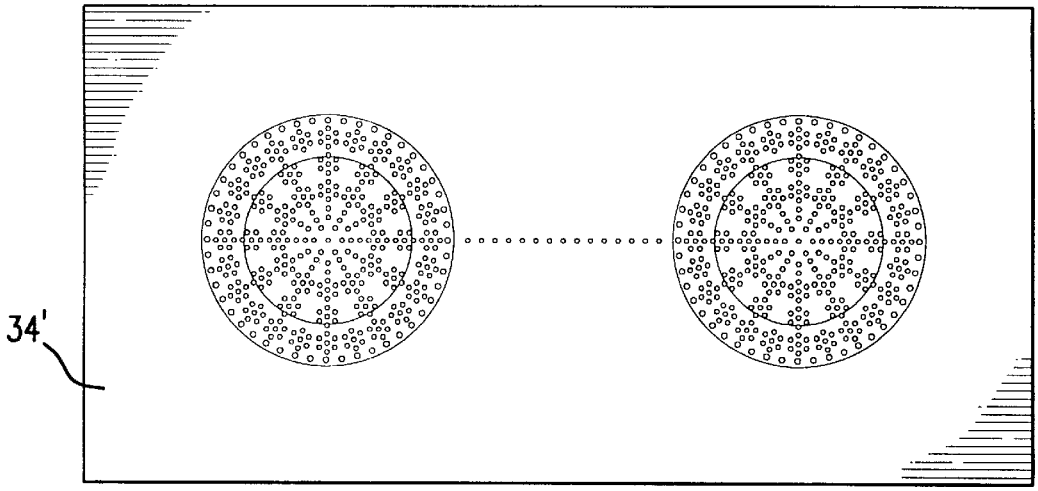
FIG. 5*a* is a plan view of a burner plate, according to another embodiment of the present invention.
Figure 5B:
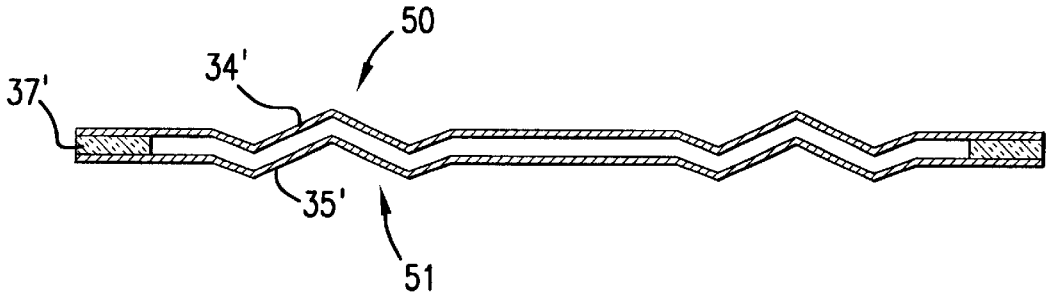
FIG. 5*b* is a side elevation of the burner plate and a corresponding baffle plate, according to the embodiment of FIG. 5*a*.
Figure 5C:
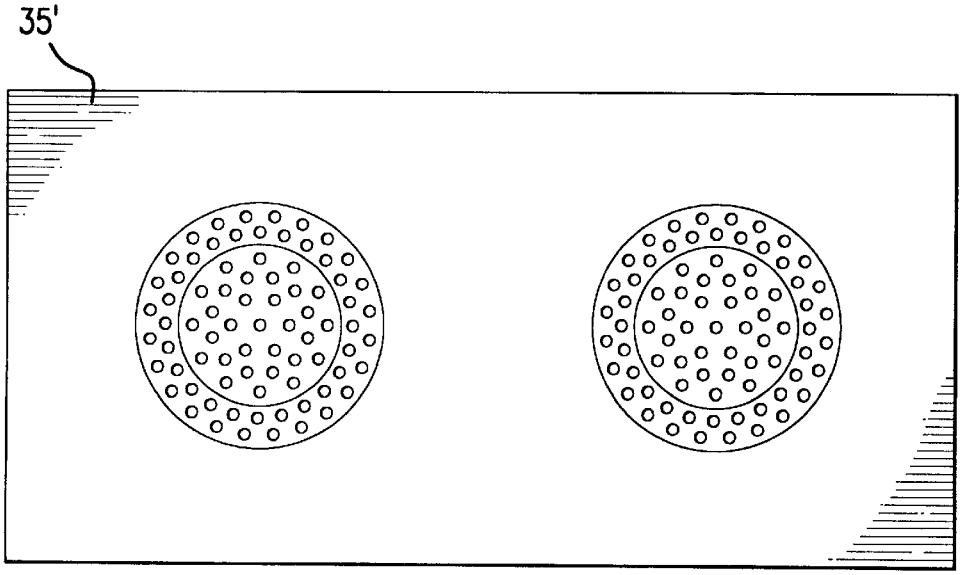
FIG. 5*c* is a plan view of the baffle plate corresponding to the burner plate of FIG. 5*a*.
Figures 6A, 6B:
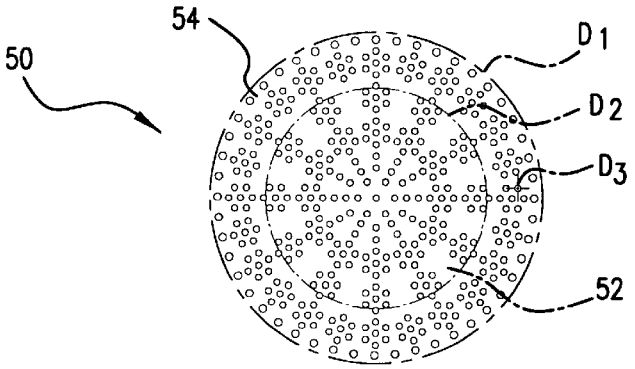
FIG. 6*a* is a plan view of a flame holder configuration, according to a preferred embodiment of the invention.
FIG. 6*b* provides data regarding the aperture sizes and locations for the flame holder configuration of FIG. 6*a*.
Figures 7A, 7B:
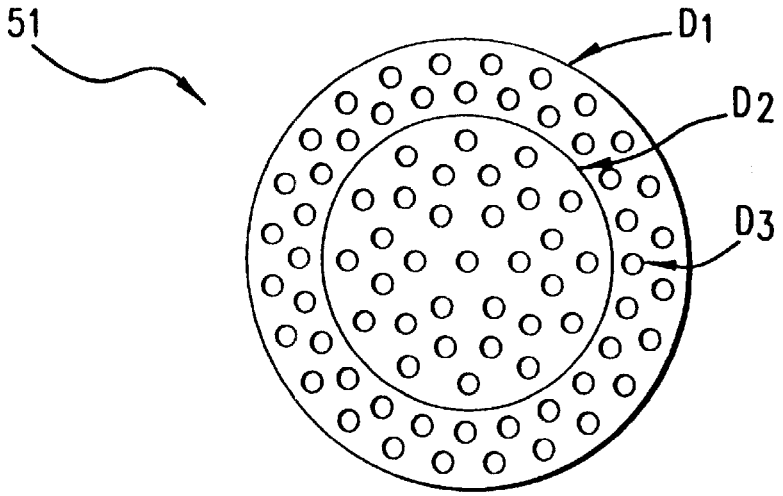
FIG. 7*a* is a plan view of a baffle port region configured to accompany the flame holder configuration of FIG. 6*a*.
FIG. 7*b* provides data regarding the aperture sizes and locations for the baffle plate port region configuration of FIG. 7*a*.

FIGS. 5*a*–5*c* illustrate a burner plate 34' and a baffle plate 35', in accordance with the principles of the present invention, having preferred porting configurations. Plates 34' and 35' are configured for two flame holder regions each. If a greater or lesser number of flame holder regions are desired (as shown in the other embodiments described herein), then plates 34' and 35' may simply be suitably shortened or lengthened, in accordance with conventional design principles by one of ordinary skill in the art having the present disclosure before them.

However many flame holder regions are provided, each burner plate (e.g., 34') and its corresponding baffle plate (e.g., 35') will have substantially identical profiles, as shown in FIG. 5*b*. Gasket/spacer members 37' will be positioned between burner plate 34' and baffle plate 35'.

The baffle plate is believed to provide assistance for distributing the mixed fuel gas and air across the width of the burner plate. The presence of the baffle plate is further believed to help reduce CO production, and to facilitate burner ignition.

FIGS. 6*a* and 6*b* and 7*a* and 7*b*, respectively, illustrate the preferred port locations and patterns for the flame holder region of a burner plate and its corresponding baffle plate region, in accordance with the principles of the present invention, for a desired port loading and burner rating. TABLE 1, below, identifies the values for the diameters ($D_1$, $D_2$ and $D_3$) for the flame holder region 50 of FIG. 6*a* and the corresponding baffle plate port region 51 of FIG. 7*a*. Although specific aperture sizes and locations are given in TABLE 1 and FIGS. 6*b* and 7*b*, such values may be modified as necessary for a given application, by one of ordinary skill in the art having the present disclosure before them.

TABLE 1

| | Diameter (in) | | |
|---|---|---|---|
| Region | $D_1$ | $D_2$ | $D_3$ |
| 50 - flame holder | 1.625 | 1.062 | 0.040 |
| 51 - baffle plate | 1.625 | 1.062 | 0.081 |

Figure 8:
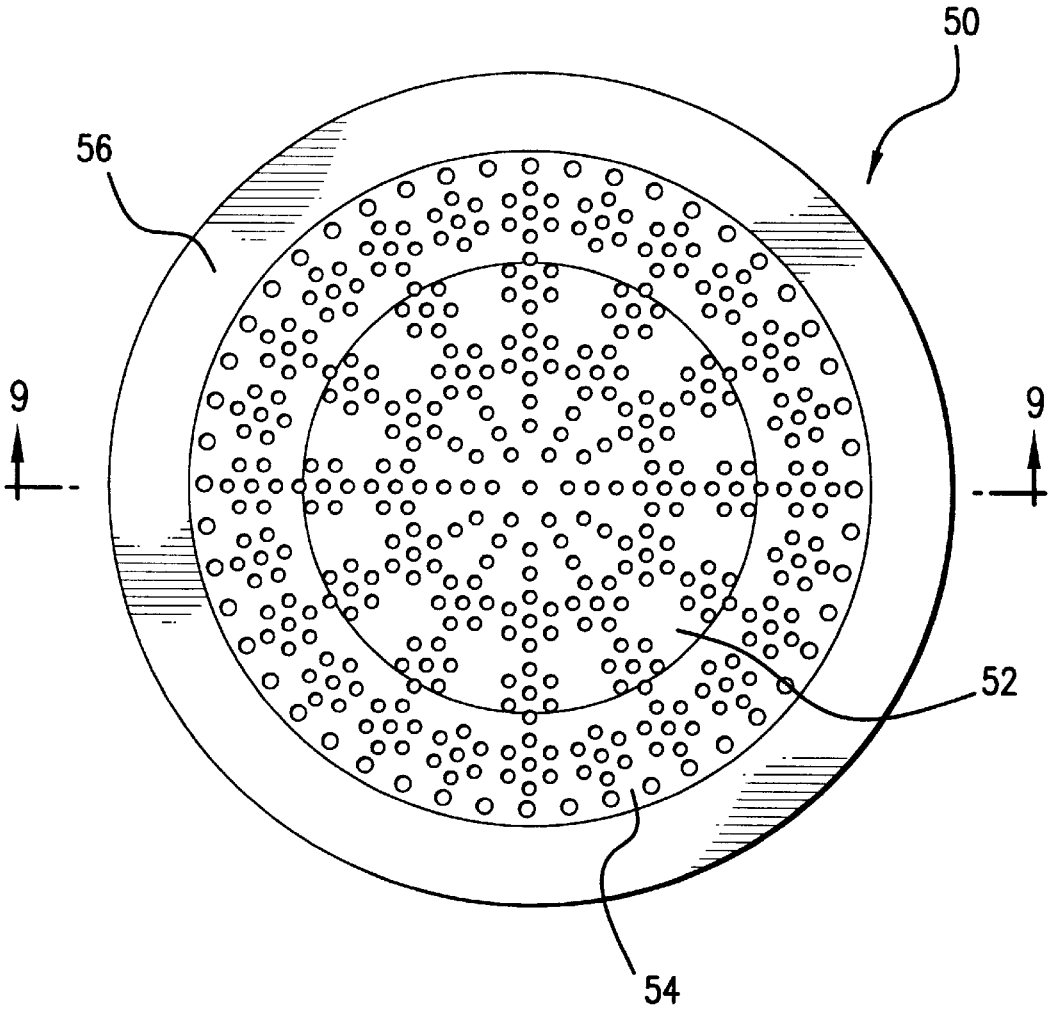
FIG. 8 is a further top plan view of the flame holder configuration of FIG. 6.
Figure 9:
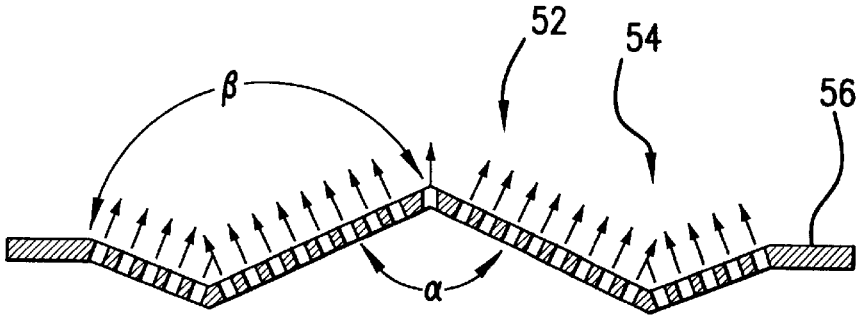
FIG. 9 is a side elevation of the flame holder configuration of FIG. 8 illustrating the mixed gas flow paths and taken substantially along the line 9—9 of FIG. 8, viewed in the direction of the arrows.

FIGS. 8 and 9 illustrate a flame holder region configuration for a burner plate in accordance with the principles of the present invention. Flame holder region 50 may be a flame holder for a single flame burner plate, or as previously indicated, two or more flame holder regions 50 may be formed on a single elongated burner plate. If a plurality of flame holder regions are provided, one or more rows of apertures will be provided to connect the separate flame holder regions, to enable cross-lighting from one flame holder region to the other. Each flame holder region 50 is circular and in the form of a convex (outwardly pointing) cone, placed within a conical depression. As seen in FIGS. 8 and 9, each flame holder region 50 comprises upwardly/outwardly projecting conical portion 52, set within conical depression portion 54, which, in turn, is surrounded by a flat region 56. Each flame holder region 50 is provided with a plurality of apertures, which may be provided in the pattern illustrated, and having the dimensions and locations provided in FIG. 6*b*.

The side profile of the flame holder region of FIGS. 8 and 9, has a center convex cone having an included angle alpha in the range of approximately 110° to 150°, preferably 130°, and an outer concave conical ring, defining an angle beta, as shown in FIG. 9, in the range of the focus of which has an included angle beta in the range of 155° to 115°, preferably 135°. The apertures are preferably of the same diameter, although the outermost single ring of apertures may be of a slightly larger diameter. The apertures should have a diameter between 0.060 in as a maximum, and the burner plate thickness, as a minimum.

The angles of the profile of the port region 51 of baffle plate(s) 35, 35' will be the same as the corresponding angles of flame holder region 50 of burner plates 34, 34'.

Whether having only a single flame holder region or a plurality of flame holder regions, the burner plate is formed from a thin plate (preferably in the range of 0.024 in–0.032 in thick), relative to its length or width. A preferable method for manufacture of such a burner plate would be to take a flat plate, and form the holes by drilling or punching. Afterward, the conical forms are created by further stamping. As such, the holes have diameters which are the same general order of magnitude as the thickness of the plate and, in turn, the lengths of the passages through the plate. The loading on each port can be in the range of 5000–70000 Btu/hr in$^2$, with a preferred maximum loading, for the configuration illustrated in FIG. 8, of 50000 Btu/hr in$^2$. The burner plate is designed to achieve the desired port loading, with a minimum material thickness between the apertures equal to approximately the radius of the apertures.

The flow pattern of the gases as they exit the flame holder region is as illustrated in FIG. 9. Once the plate has been stamped or otherwise formed, after the apertures have been drilled, to have the conical profile shown in FIG. 9, the fluid flow through the plate, at any given location in the flame holder region, is generally perpendicular to the immediately surrounding plate surface at that given location. This is believed to possibly be the result, at least in part, of the fact that the side walls of the individual apertures are, after stamping or other forming, likewise generally perpendicular to the immediately surrounding plate surface at that given location. The flow of the gases, from the central portion (the elevated cone) 52 is upwardly and radially outward, with the exception of the aperture at the precise apex of the cone. In the conical depression region 54 surrounding the upraised cone 52, the flow is upward and radially inward. This has the effect of directing the individual flamelet groups around the periphery of the flame holder region toward the center of the flame, and away from the side walls of the heat exchanger. This helps prevent impingement of the outer flamelet groups against the side walls, and the resultant quenching, caused by sudden heat loss, of those flamelet groups which might otherwise occur upon such contact. In turn, this flame holder construction helps keep the periphery of the flame hot, which helps aerodynamically stabilize the overall flame and help prevent flame lift-off from the burner plate.

An additional feature which is believed to assist in the improvement of the flame characteristics is the clustering of groups of apertures. The hexagonal patterns (with apertures in the centers of the hexagons) is believed to impart stability to the individual flamelets and thus maintain a quiet flame. A further advantage of the premixed burner configurations of the present invention is that a greater capacity for turndown of heat input (approx. 6:1 or greater) is obtainable, as opposed to conventional burner systems, having partially premixed gas and air (approx. 3:1 max.).

The present invention is also directed to an improved burner housing and plenum configuration, for enhancing the operation of the burner plate apparatus described hereinabove.

Figure 11:
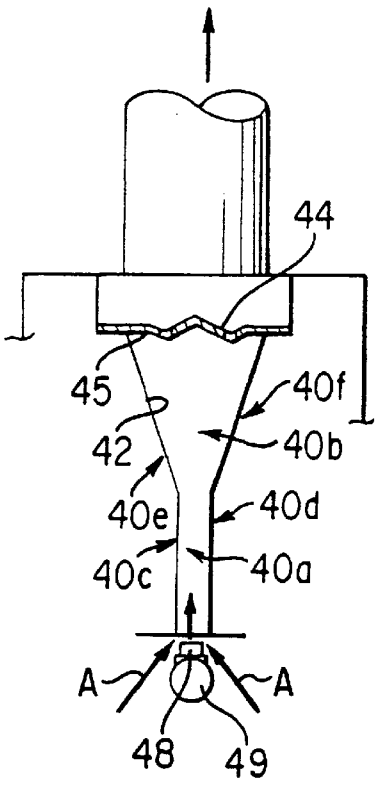
FIG. 11 is an end elevation of the burner/plenum configuration, according to the embodiment of FIG. 10.
Figure 10:
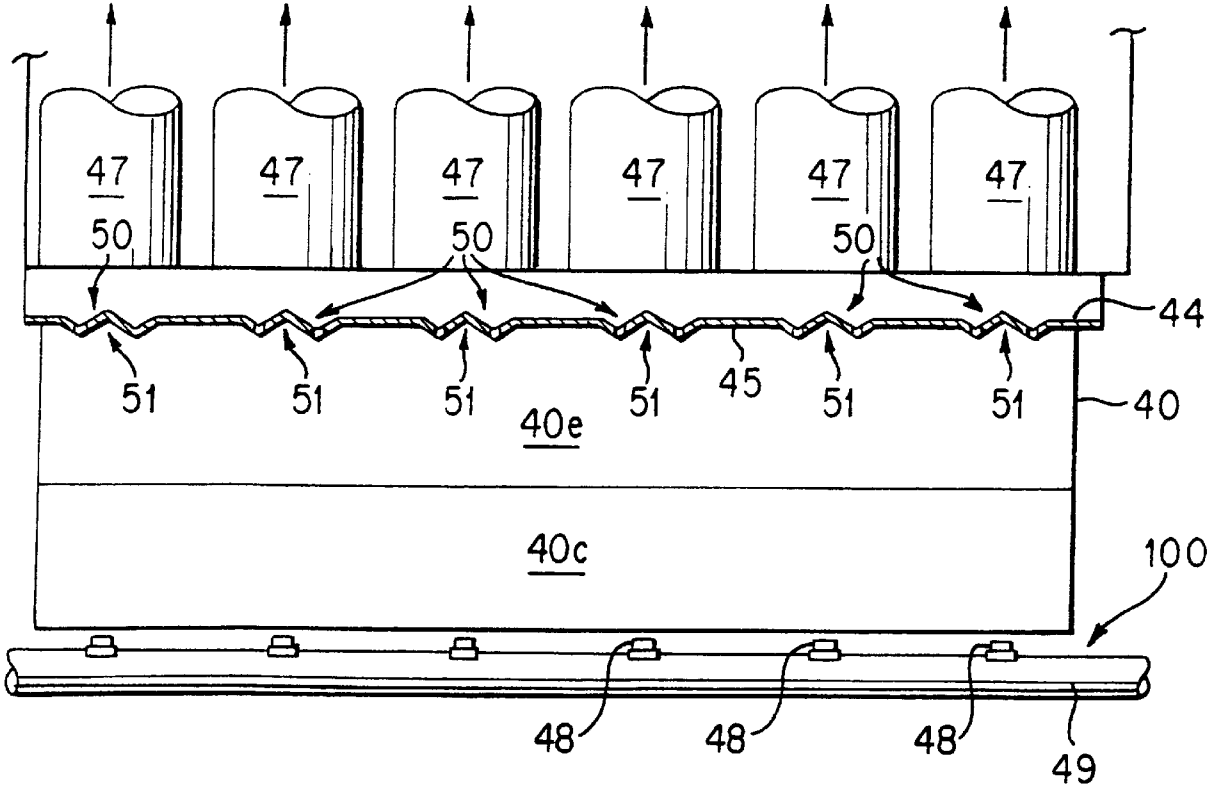
FIG. 10 is a top plan view, in section, of an alternative burner/plenum configuration.

FIGS. 10 and 11, illustrate portions of a burner/plenum configuration having a multiple feed plenum having a gas spud for each burner, wherein each flame holder region 50 of burner plate 44 preferably has the configuration of flame holder region 50 of FIGS. 8–11. Baffle plate 45 likewise has port regions 5 1, which are preferably the same as illustrated in FIGS. 5*b* and 7.

Plenum housing 40 forms a burner inlet plenum chamber 42. Plenum housing 40 has substantially flat sides, and thus a substantially constant width, and top and bottom walls 40*c* and 40*d*, respectively, having planar portions, defining a narrow mixing region 40*a* having a substantially constant thickness. A pressure recovery region 40*b* is defined by top and bottom walls 40*e* and 40*f*, respectively. Region 40*b* has a triangular cross-section providing a substantially increasing cross-section. As the mixed gases enter region 40*b*, the static pressure of the gases rises, while the dynamic pressure and linear velocity drop. Pressure recovery region 40*b* promotes the distribution of the mixed gases across the height of plenum housing 40.

Plenum chamber 42 is faced by baffle plate 45 having port regions 51. Baffle 45 provides a further pressure recovery region, between baffle 45 and burner plate 44, which is less abrupt than that in region 40*b*, promoting further distribution of the gases across the width of burner plate 44. By changing the side-to-side width of housing 40, a greater or lesser number of flame holder regions may be accommodated. Plenum housing 40 is supplied by separate gas spuds 48 opening from a gas manifold 49 and air as signified by the arrows A in FIG. 11. The flames from flame holder regions 50 extend into heat exchanger tubes 47.

Figure 12:
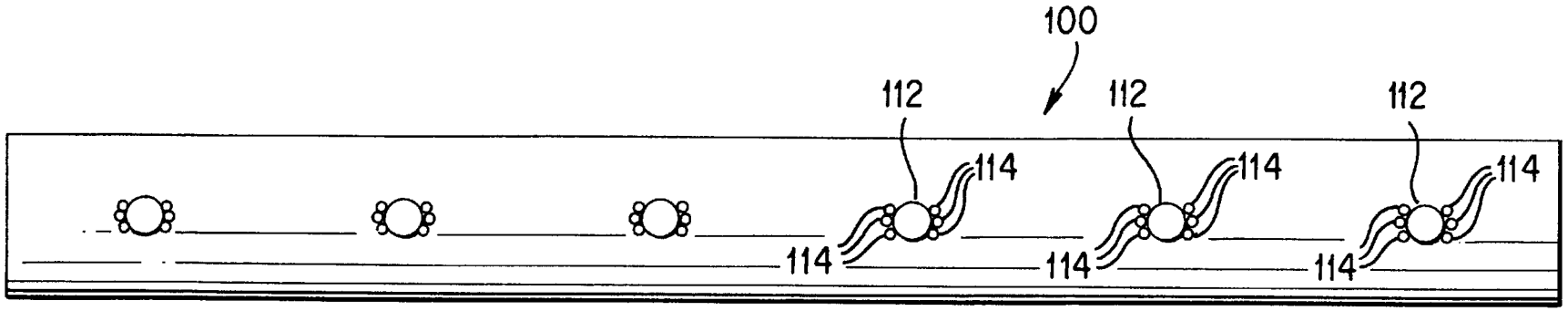
FIG. 12 is a schematic elevation of an air inlet plate configuration contemplated for use with the burner and plenum configurations of FIGS. 10 and 11 of the present invention.
Figure 13:
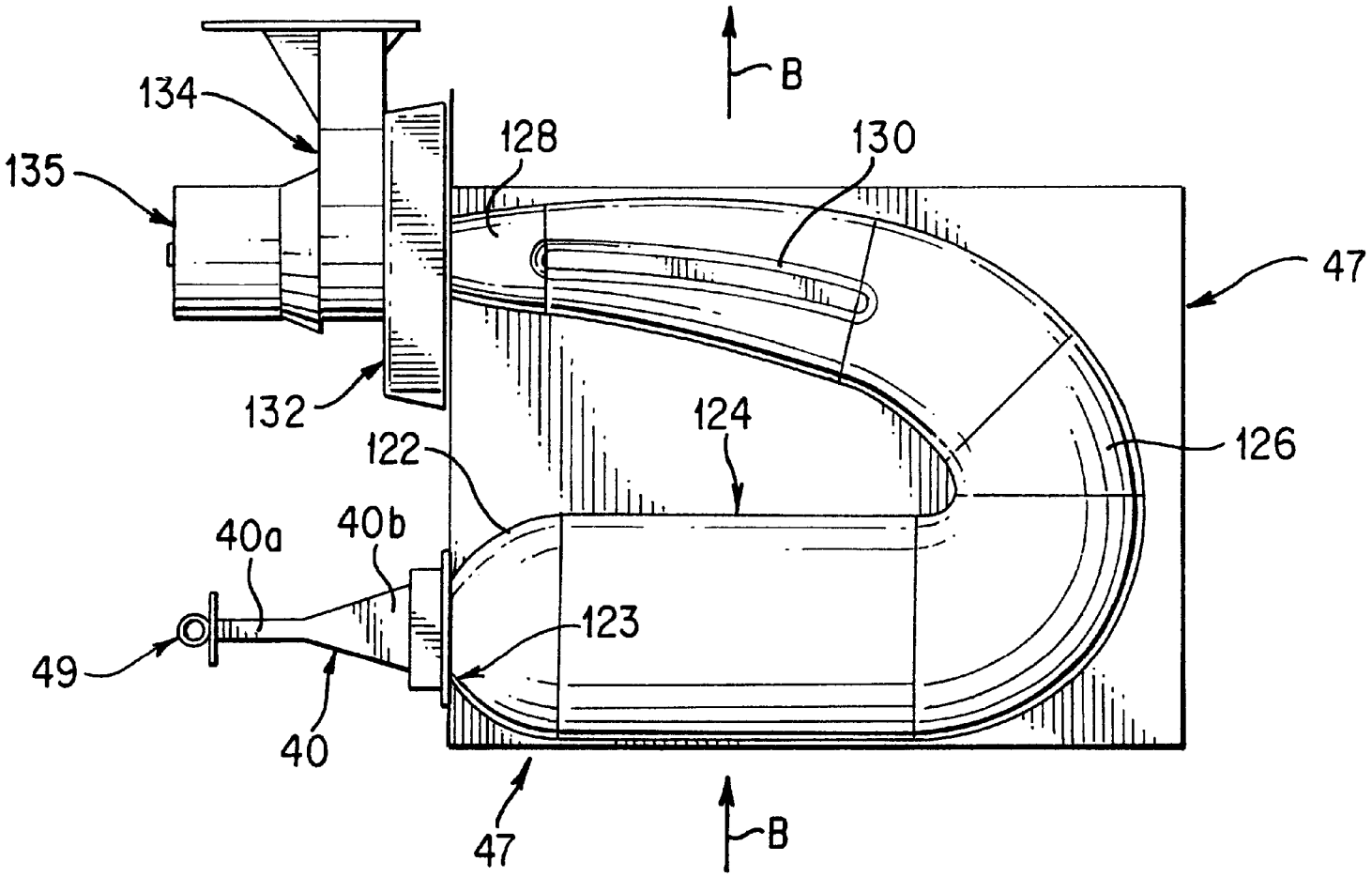
FIG. 13 is a side elevation of a burner plenum, heat exchanger, and inducer fan combination, in accordance with one preferred embodiment of the present invention.
Figure 15:
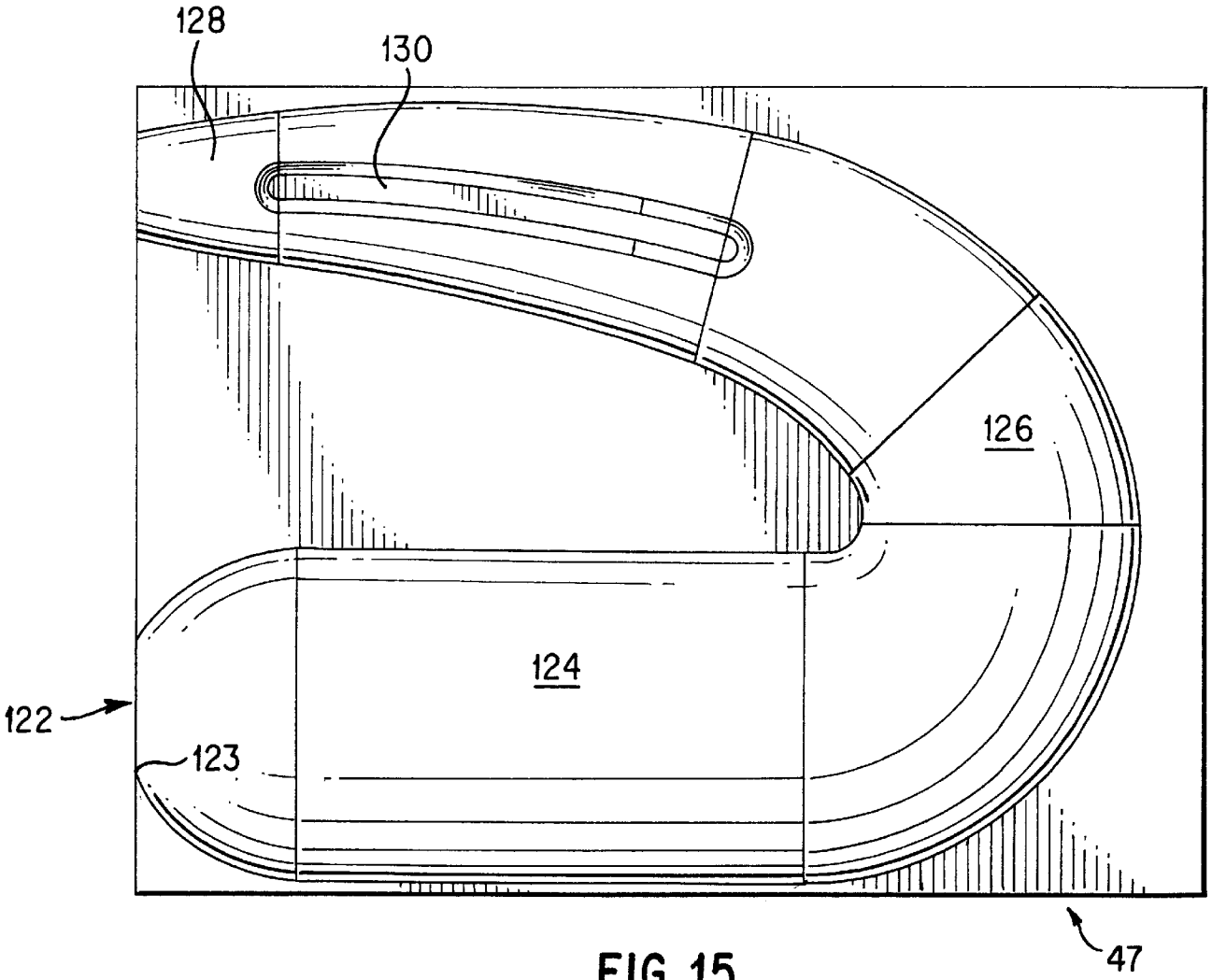
FIG. 15 is a side elevation of the heat exchanger of FIGS. 13 and 14.
Figure 14:
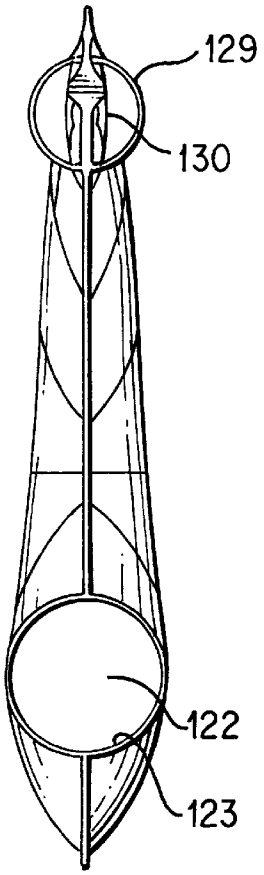
FIG. 14 is an end elevation of the heat exchanger of FIG. 13.
Figure 16:
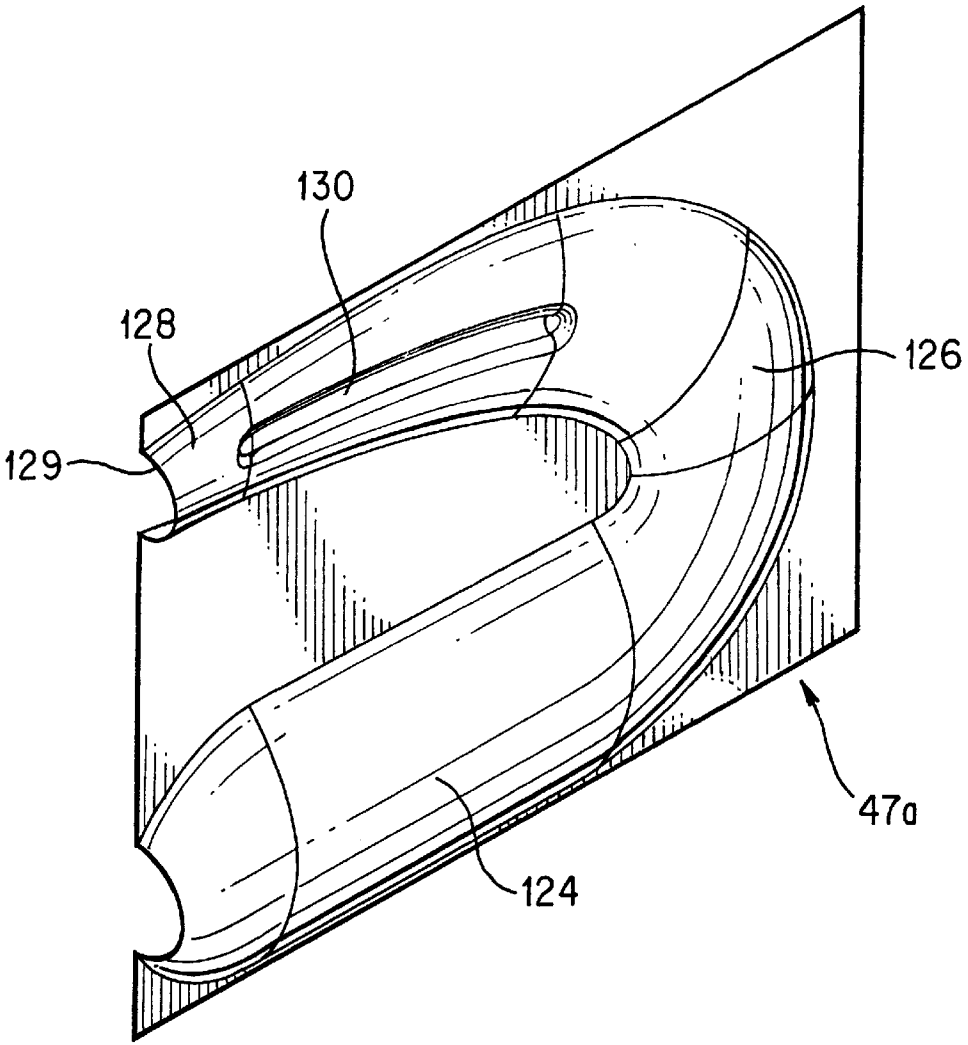
FIG. 16 is a perspective view of one half of a heat exchanger of the embodiment of FIGS. 13–15.

FIG. 12 illustrates air inlet plate 100 preferably used in association with the burner construction of FIGS. 8–11. Air inlet plate 100 will be provided with a plurality of fuel inlet apertures 112, which will be positioned so as to be concentric to corresponding ones of gas spuds 48. Surrounding each fuel inlet aperture 112 will be a plurality of air inlet apertures 114. In operation, fuel is expelled, under sufficient pressure, from spuds 48 (FIG. 11) such that the entire stream of fuel gas passes through the respective fuel inlet apertures 112, and into plenum housing 40. Air ambient to the gas spuds 48 is drawn by inducer fan 134 (see FIG. 14) through air inlet apertures 114, to provide the combustion air for premixing in region 40*a*.

Referring to FIGS. 13–17, heat exchangers 47 are placed in a housing (not shown), which may be of otherwise conventional configuration. Typically, each heat exchanger 47 may be formed as two stamped halves, e.g., half 47*a*, shown in FIG. 16, forming a tube, with the tube for the passage of the combustion products having what might be referred to as an "apostrophe"-shape. In cross-section (FIGS. 17A, 17B, 17C, 17D, 17E, 17F, 17G, 17H, 17J and 17K), each region of the heat exchanger has a greater height than width, with a generally pointed elliptical shape. The inlet 122 expands rapidly from circular opening 123 to a first section 124 which is substantially straight and has a substantially constant height, width and cross-section along its length. The transverse cross-sectional configuration of the heat exchanger tube has a substantially constant area in the first section 124.

A second arcuate section 126, which has a steadily decreasing height and width, and thus a generally decreasing cross-sectional area, ends in a truncated triangular outlet section 128, which ends in a flared exit opening 129. Each heat exchanger includes a pair of opposed indentations 130 which project into the interior of the heat exchanger. Indentations 130 are provided to maintained a desired flow velocity and distribute the flow of combustion gases evenly about the inner surface of the heat exchanger tube. Flow velocity is maintained, because the indentations reduce the transverse cross-sectional area of the passageway. At the same time, the surface area of the inner surface of the tube is increased, which enhances heat transfer from the combustion gases, through the heat exchanger walls, to the air being heated, signified by the arrows B in FIG. 13.

Figures 17A, 17B, 17C, 17D, 17E, 17F, 17G, 17H, 17J, 17K:
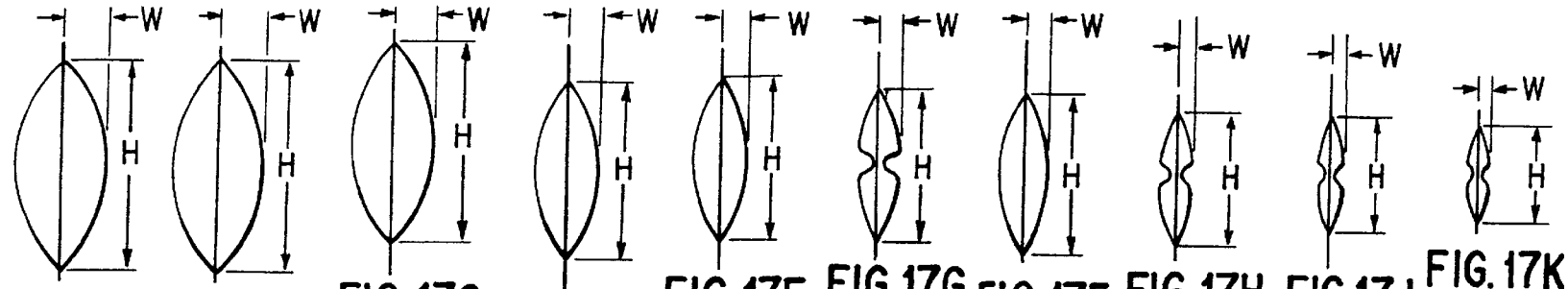
FIGS. 17A, 17B, 17C, 17D, 17E, 17F, 17G, 17H, 17J and 17K are cross sectional views of heat exchanger of FIG. 17 taken substantially along the respective lines of FIG. 17 and viewed in the direction of the respective arrows.
Figure 17:
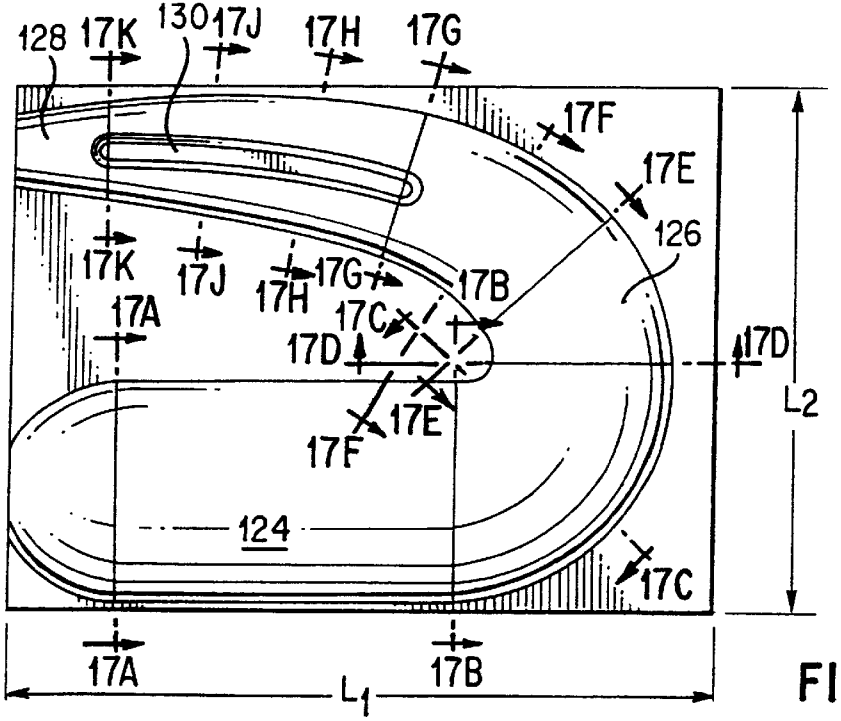
FIG. 17 is a side elevation of the heat exchanger of FIGS. 13 and 14 but now showing certain dimensions and the locations for certain cross sectional views thereof.
Figure 17X:
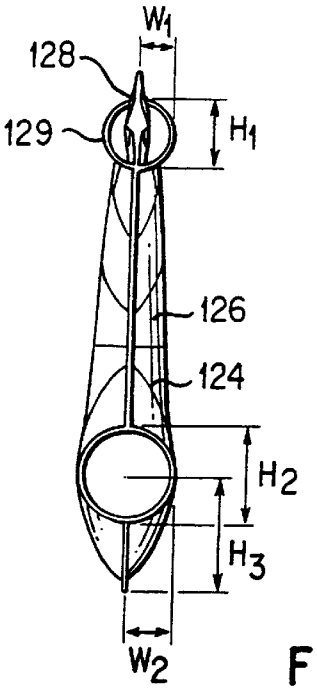

FIGS. 17A, 17B, 17C, 17D, 17E, 17F, 17G, 1711, 17J and 17K illustrate in detail, the contours of a heat exchanger 47. Representative values for the contours (height and width) are provided in TABLE 2 below and representative specified lengths and widths shown in FIGS. 17 and 17X are provided in TABLE 3 below. Although specific numerical values are given, these may be somewhat modified according to the requirements of a particular application, in accordance with the principles of the present invention, by one of ordinary skill in the art having the present disclosure before them, without departing from the scope of the invention.

TABLE 2

| FIG. | H (in) | W (in) |
|---|---|---|
| 17A | 6.31 | 1.38 |
| 17B | 6.31 | 1.37 |
| 17C | 5.80 | 1.23 |
| 17D | 5.25 | 1.00 |
| 17E | 4.87 | 0.85 |
| 17F | 4.67 | 0.74 |
| 17G | 4.50 | 0.63 |
| 17H | 3.91 | 0.51 |
| 17J | 3.45 | 0.40 |
| 17K | 3.00 | 0.37 |

TABLE 3

| Portion | Dimension (in) |
|---|---|
| $L_1$ | 20.00 |
| $L_2$ | 15.00 |
| $W_1$ | 1.00 |
| $W_2$ | 1.38 |
| $H_1$ | 2.00 |
| $H_2$ | 2.75 |
| $H_3$ | 3.32 |

The outlets 128 of the individual heat exchangers all connect to a common collection duct 132, in which a flow inducer fan 134, having an associated motor 135, is located, preferably at the exit, to draw the combustion gases through the heat exchangers. After exiting the collection duct, the collected combustion gases are directed to a chimney or flue, which may be of otherwise conventional configuration.

Figure 18:
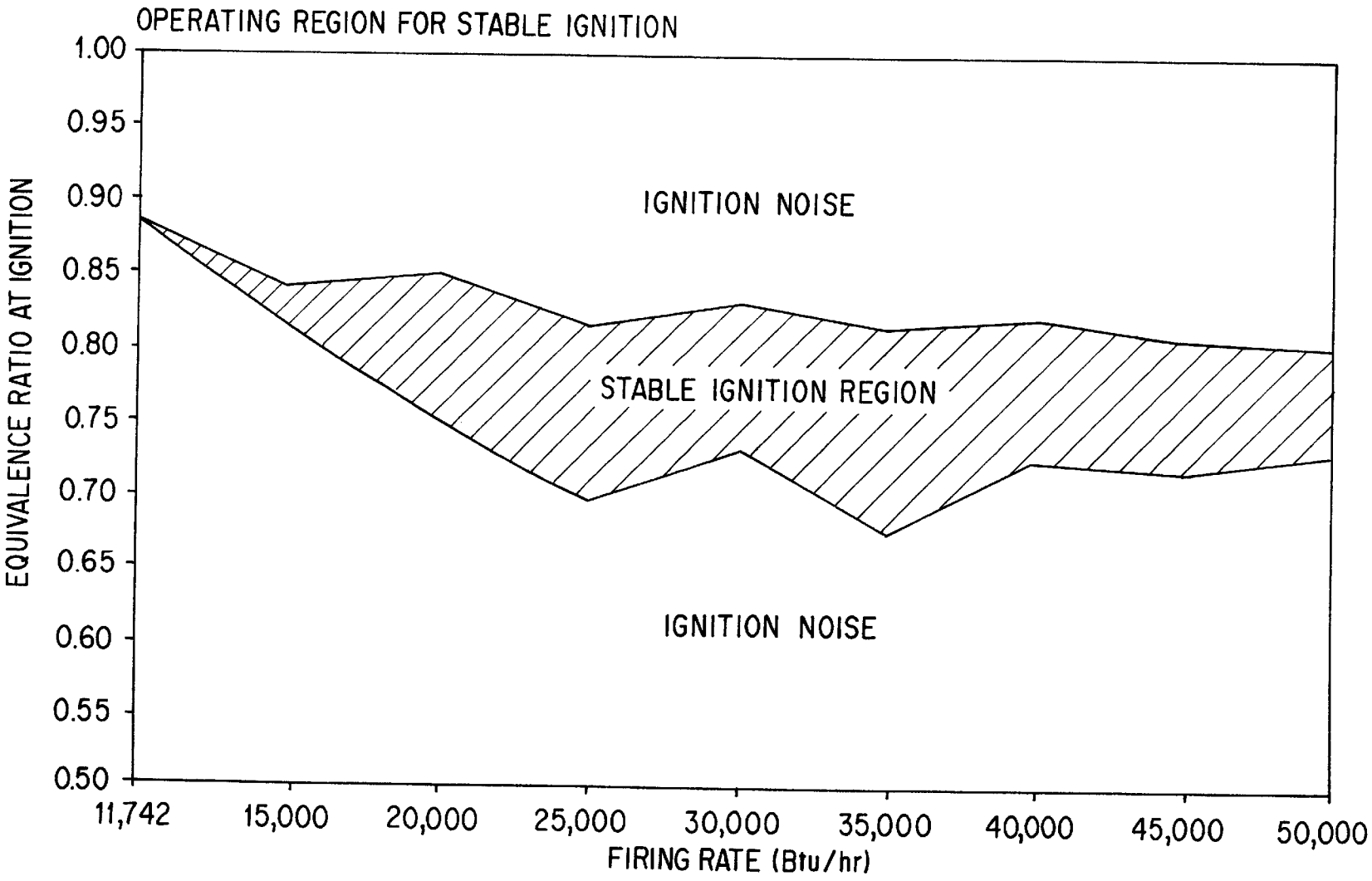
FIG. 18 is a plot of observed performance of a burner in accordance with the principles of FIGS. 8 and 9.

FIG. 18 illustrates noted performance of a burner having flame holders such as shown and described with respect to FIGS. 8 and 9.

Figure 19:
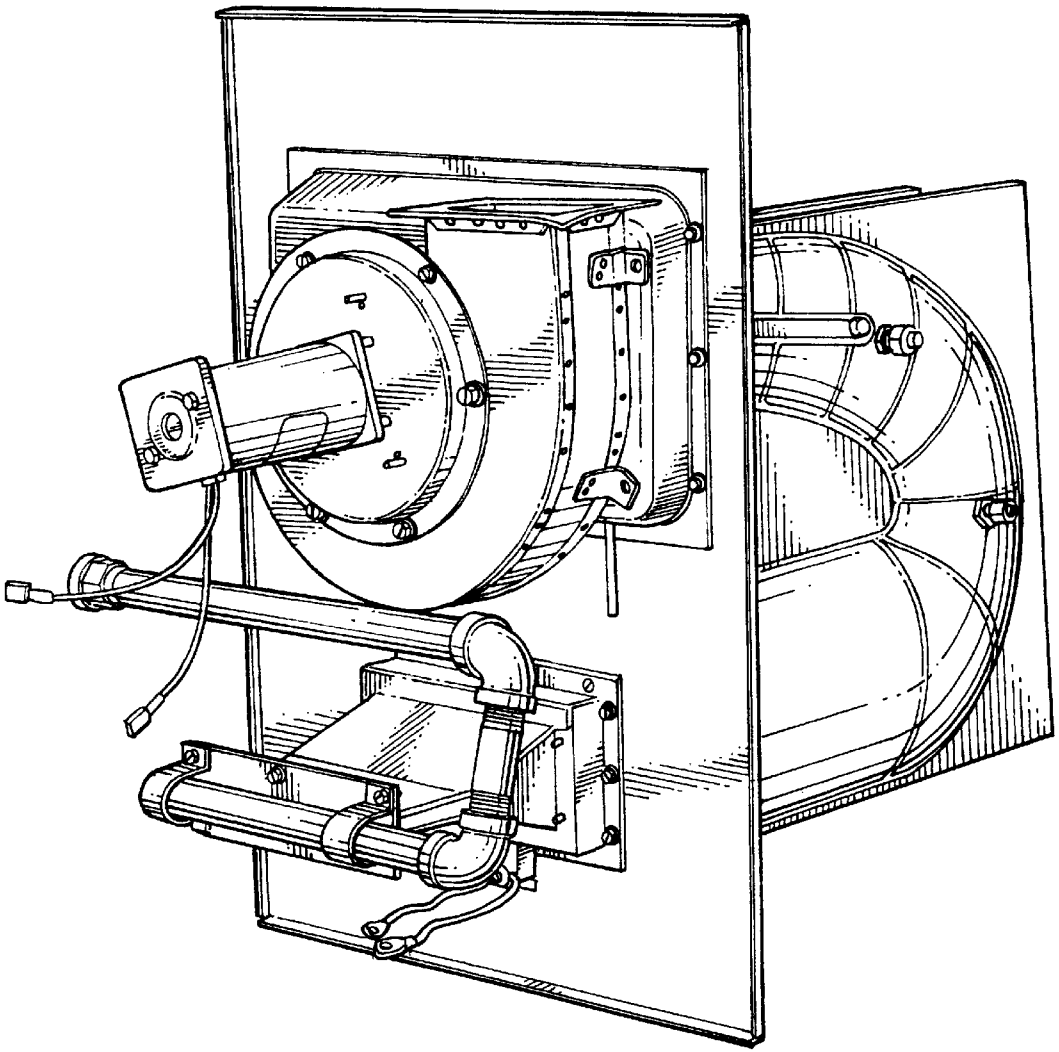
FIG. 19 is a perspective view of a heat exchanger, plenum, collection box and inducer fan, in accordance with the principles of the present invention.
Figure 20:
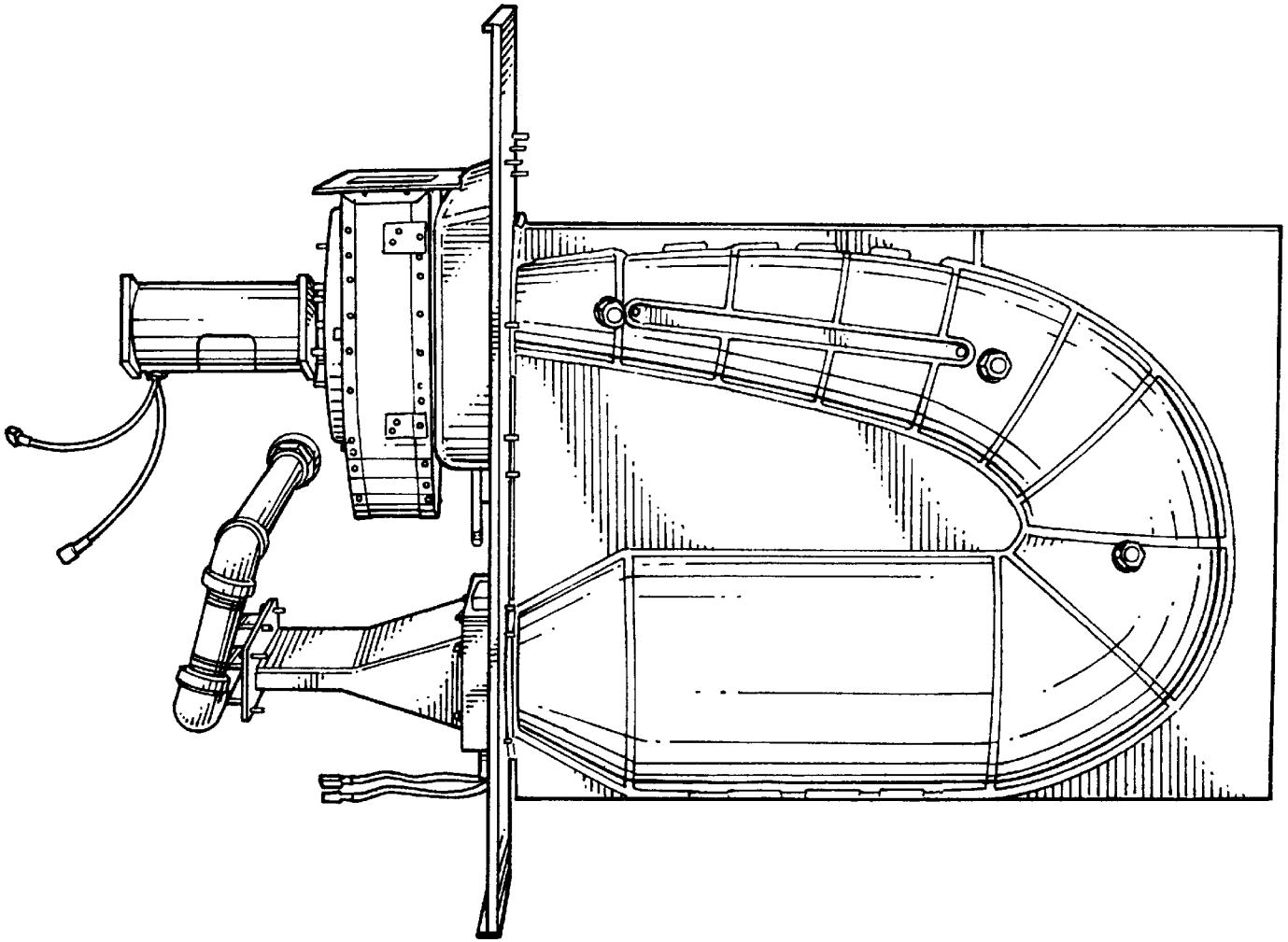
FIG. 20 is a side elevation of the apparatus of FIG. 19.

FIG. 19–20 illustrate an example of a plenum/heat exchanger apparatus in accordance with the principles of the present invention.

While the invention has been described above with reference to a fully premixed, gas-fired, induced draft burner apparatus configured to fire into tubular or clamshell-type heat exchangers, such as are found in residential warm air furnaces, and which burner apparatus, such as shown in FIG. 11, includes a plenum housing 40 having substantially flat sides, and thus a substantially constant width, and top and bottom walls 40*c* and 40*d*, respectively, having planar portions, defining a narrow mixing region 40*a*, the broader practice of the invention is not necessarily so limited.

As described in greater detail below, the invention may, if desired, be applied to partially premixed burner and plenum configurations such as may similarly be configured to fire into tubular or clamshell-type heat exchangers, such as are found in residential warm air furnaces. Further, the invention may be practiced with burner housing configurations which do not include such a narrow mixing region.

Figure 21:
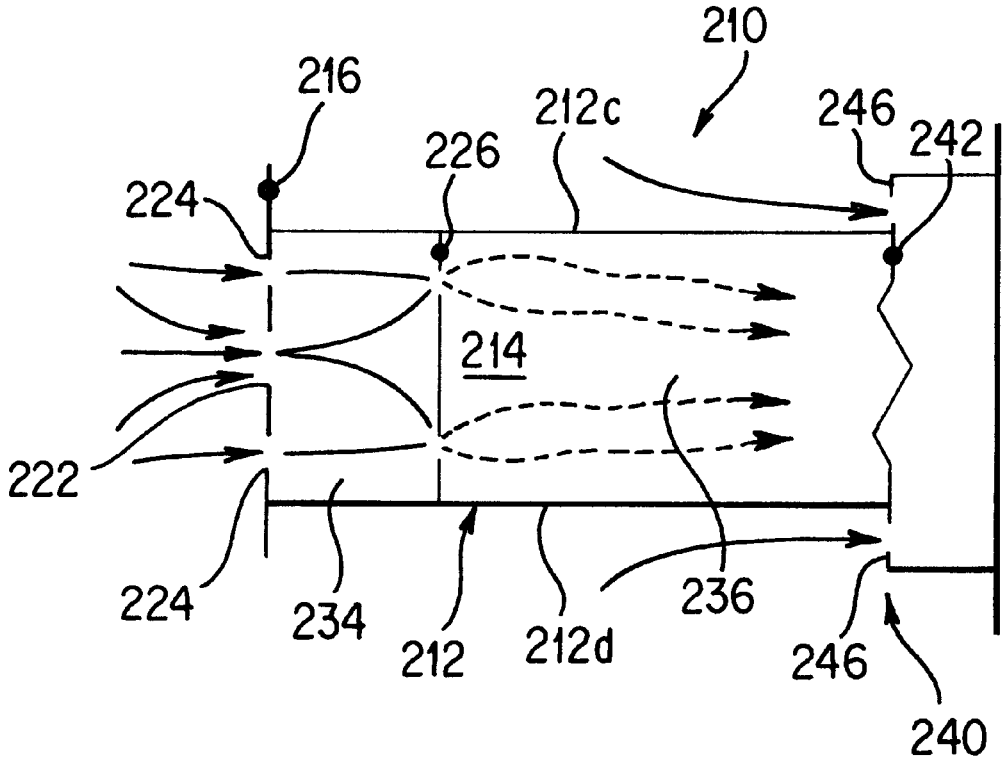
FIG. 21 is an end elevation, similar to that shown in FIG. 11, of a partially premixed burner/plenum configuration in accordance with an alternative embodiment of the invention.

For example, turning now to FIG. 21 there is shown a burner/plenum configuration in accordance with an alternative embodiment of the invention and generally designated by the reference numeral 210. The burner/plenum configuration 210 includes, as shown in greater detail in FIG. 22, a partially premixed burner housing 212 having substantially flat and parallel lateral side walls 212*a* and 212*b*, respectively, and thus a substantially constant width, and substantially flat and parallel top and bottom side walls 212*c* and 212*d*, respectively, and thus a substantially constant thickness. As will be appreciated, such side walls can be formed directly continuous of one or more pieces or joined together from two or more pieces, as may be desired.

As perhaps most clearly shown in FIG. 21, the side walls form an interior volume, generally designated by the reference numeral 214. An inlet plate 216 is connected to the side walls at one end thereof.

Figure 23:
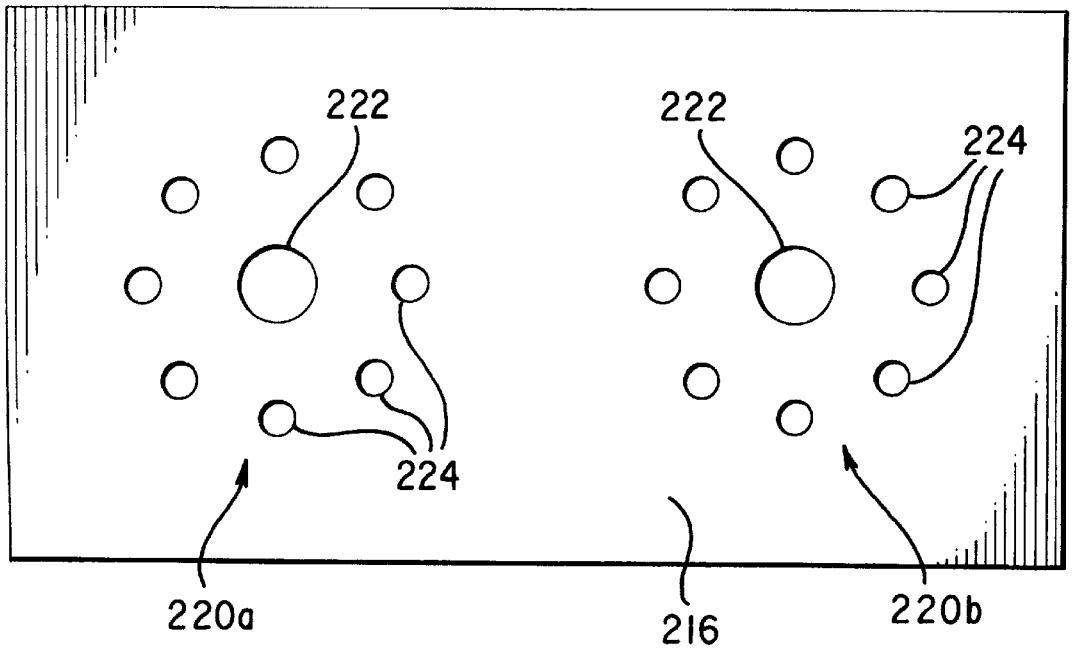
FIG. 23 is a plan view of an inlet plate of the burner/plenum configuration shown in FIG. 21.

FIG. 23 is a plan view of the inlet plate 216, in accordance with the principles of the present invention, having preferred porting configurations. In particular, the inlet plate 216 includes two inlet regions 220*a* and 220*b*, respectively. As will be appreciated by those skilled in the art, inlet plates in accordance with the invention may include greater or lesser numbers of inlet regions as may be desired. For example, the inlet plate 216 may simply be suitably shortened or lengthened, in accordance with conventional design principles by those skilled in the art having the present disclosure before them.

Each of the inlet regions 220*a* and 220*b*, respectively, includes a central opening 222 and an array of multiple surrounding openings 224. The central openings 222 generally enables the injection of gaseous fuel therethrough and are thus sometimes referred to herein as "fuel inlet apertures." The fuel inlet apertures 222 are preferably positioned to be generally concentric to corresponding gas spuds (not shown), in accordance with typically preferred design considerations and as described above. The surrounding openings 224 generally enable ambient air to be drawn therethrough such as by means of a suction source disposed downstream of the burner housing 212. Such ambient air may be drawn through the openings 224 such as by means of an inducer fan (not shown), such as described above. As will be appreciated, some portion of the total amount of primary combustion air may additionally be introduced by means of the central openings 222.

As described above, fuel is typically expelled from the corresponding gas spuds under sufficient pressure such that the entire stream of fuel gas passes through the respective fuel inlet apertures 222 and into the housing 212.

Figure 24:
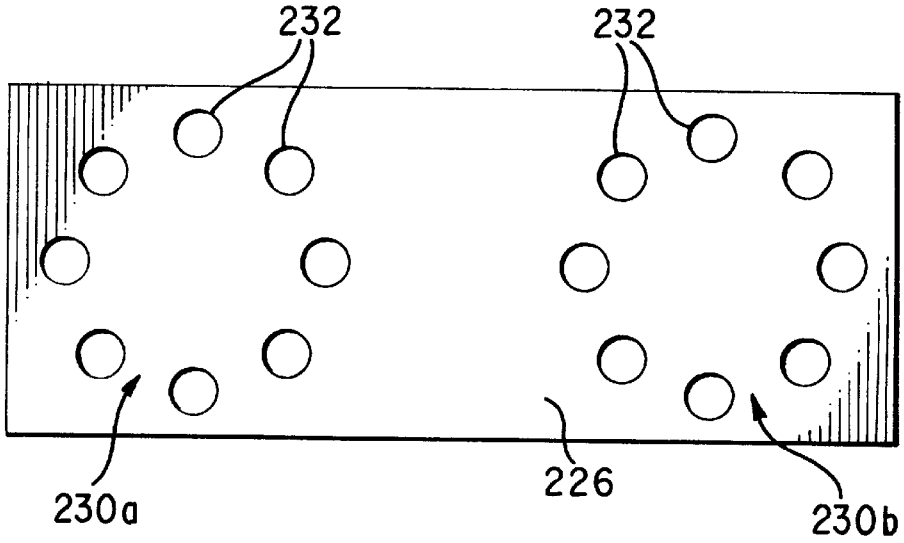
FIG. 24 is a plan view of a target plate of the burner/plenum configuration shown in FIG. 21.

A target plate 226 is longitudinally spaced from the inlet plate 216 and is joined or connected to the side walls. The target plate 226, as shown in greater detail in FIG. 24, includes two flow passage regions, individually designated 230*a* and 230*b*, respectively. Each of the target plate flow passage regions 230*a* and 230*b* generally corresponds and is aligned with a counterpart inlet plate inlet region 220*a* and 220*b*, respectively. Each of the target plate flow passage regions 230*a* and 230*b* is composed of a generally circular array of a plurality of passage openings 232.

Thus, as shown in FIG. 21, within the burner/plenum configuration interior volume 214 there is defined an introduction zone 234 for the introduction of the combustion air and gaseous fuel to the interior volume 214 and a mixing zone 236 for the mixing of the gaseous fuel and combustion air.

Figure 22:
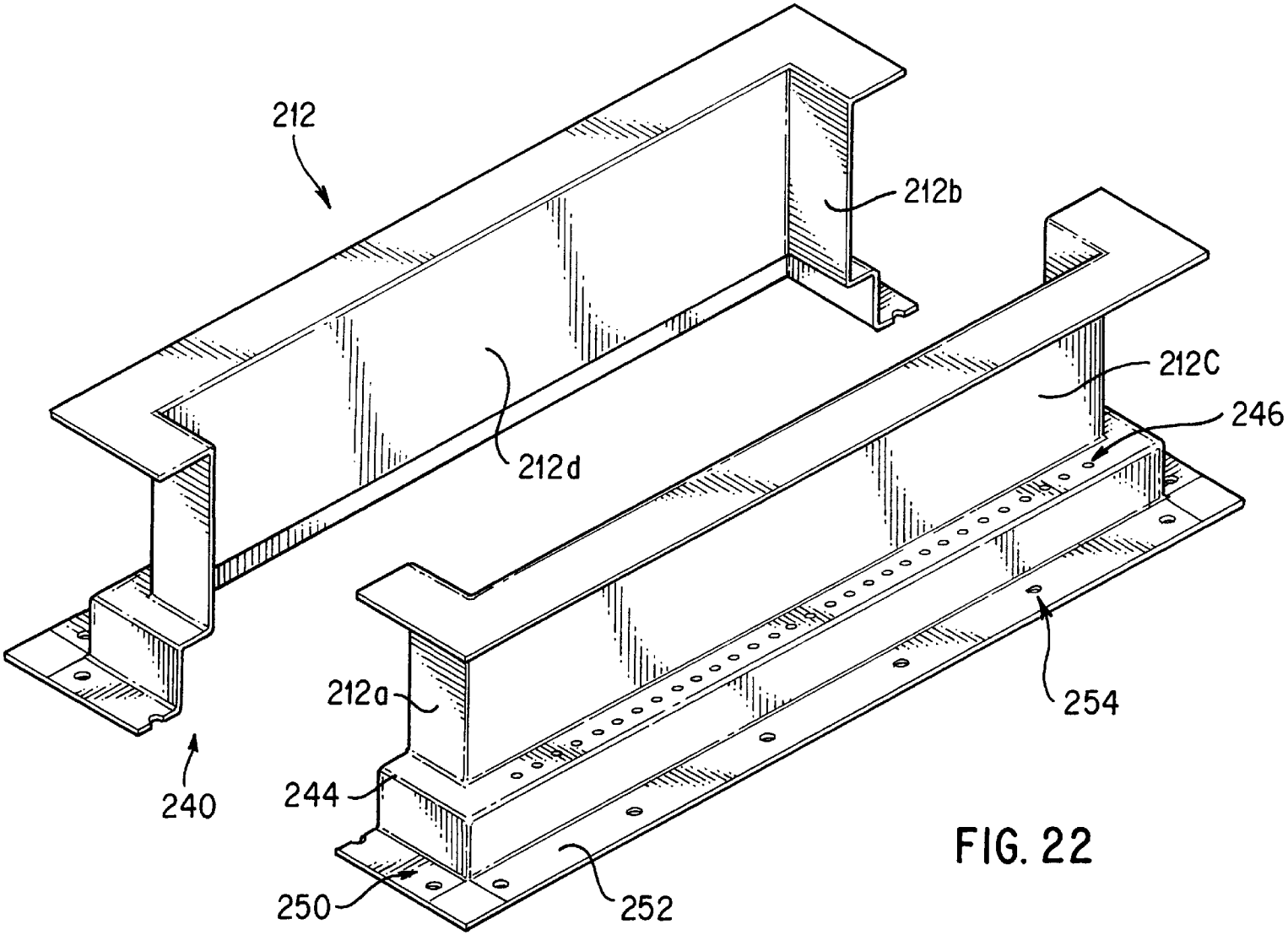
FIG. 22 is a fragmentary perspective view of a burner housing for use in the burner/plenum configuration shown in FIG. 21.

As shown in FIGS. 21 and 22, the burner housing 212 includes a burner plate holding section, generally designated by the reference numeral 240. As shown in FIG. 21, the burner plate holding section 240 is generally adjacent the mixing zone 236 and adapted to hold a burner plate 242 adjacent an end of the side wall opposite the inlet plate 216. The burner plate holding section 240 of the illustrated embodiment includes a shoulder portion 244 adapted to be joined in substantial circumferential surrounding relationship with the burner plate 242. The shoulder portion 244 includes a plurality of air inlet apertures 246 for enabling ambient secondary air to be drawn into reaction contact with the mixed gaseous fuel and combustion air.

As shown in FIG. 22, the burner housing 212 further includes an attachment throat portion 250 generally adjacent or extending from the burner plate holding section 240 and permitting the attachment or joining of the burner/plenum configuration 210 to a corresponding unit or assembly, such as a furnace heat exchanger, as described above. To that end, the attachment throat portion 250 includes a mating flange section 252 including a plurality of fastener attachment openings 254 where through a selected fastener (not shown) can be passed to secure the burner/plenum configuration 210 to a corresponding unit or assembly.

Figure 25:
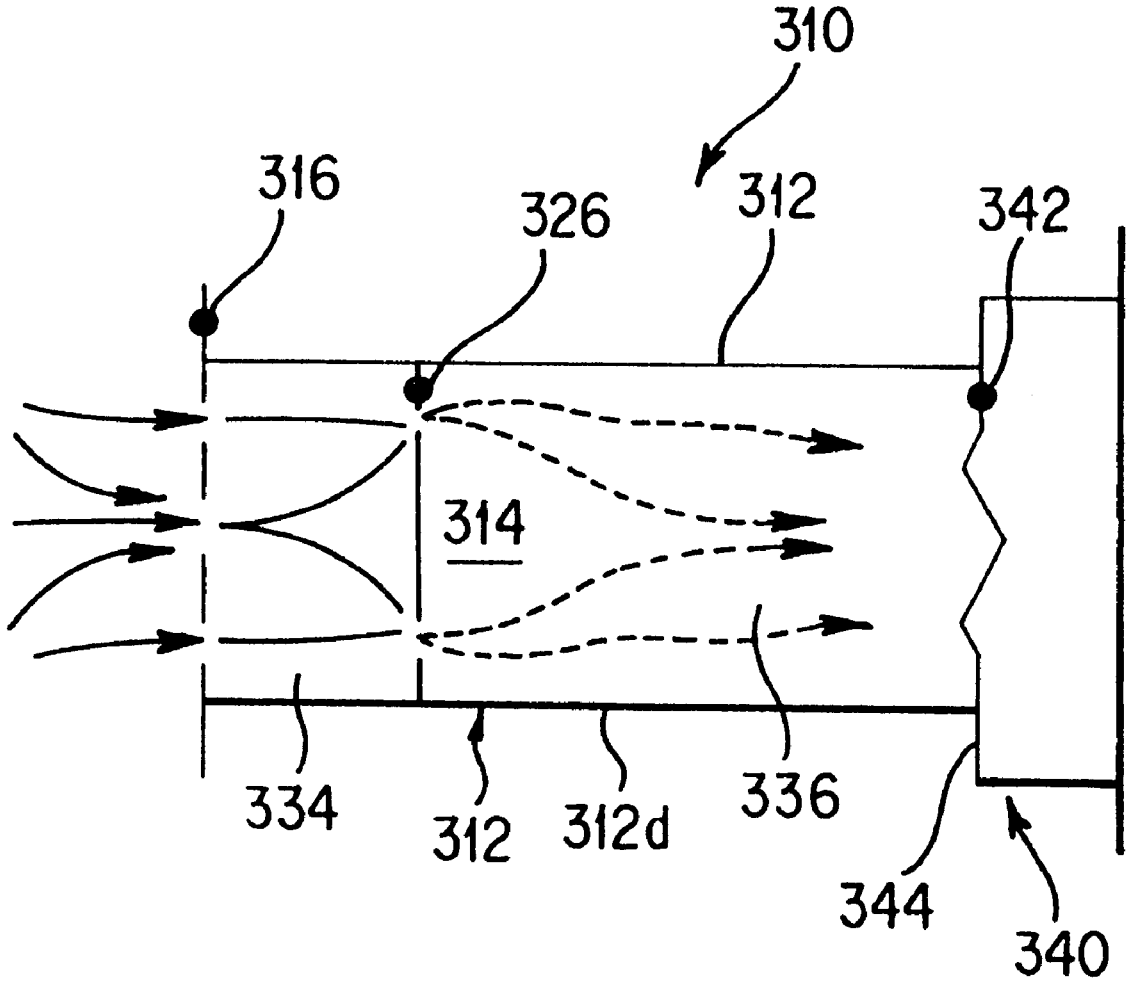
FIG. 25 is an end elevation, similar to that shown in FIG. 11, of a fully premixed burner/plenum configuration in accordance with an alternative embodiment of the invention.

While the invention has been described above relative to a partially premixed burner and plenum configuration shown in FIGS. 21 and 22, as will be appreciated by those skilled in the art, the invention may correspondingly be practiced in a fully premixed mode using a generally similarly configured burner housing, if desired. For example, turning to FIG. 25 there is illustrated a fully premixed burner/plenum configuration, generally designated by the reference numeral 310, in accordance with an alternative embodiment of the invention.

The burner/plenum configuration 310 is generally similar to the burner plenum configuration 210 shown in FIG. 21 and described above. For example, the burner/plenum configuration 310 similarly includes a burner housing 312, an inlet plate 316, a target plate 326, and a burner plate 342. The burner housing 312, similar to the burner housing 212 described above, includes substantially flat and parallel lateral side walls (not shown) and thus has a substantially constant width, and substantially flat and parallel top and bottom side walls 312*c* and 312*d*, respectively, and thus has a substantially constant thickness. As described above, such side walls can be formed directly continuous of one or more pieces or joined together from two or more pieces, as may be desired. The burner housing 312 thus forms an interior volume 314 wherein is defined an introduction zone 334 for the introduction of the combustion air and gaseous fuel to the interior volume 314 and a mixing zone 336 for the mixing of the gaseous fuel and combustion air.

The burner housing 312 also similarly includes a burner plate holding section 340. The burner plate holding section 340 includes a shoulder portion 344 adapted to be joined in substantial circumferential surrounding relationship with the burner plate 342 and adapted to hold the burner plate 342 adjacent an end of the side wall opposite the inlet plate 316. The burner housing 312 differs from the burner housing 212, however, in that the burner housing 312 does not permit secondary combustion air to be drawn into reaction contact with the mixed gaseous fuel and combustion air downstream of the burner plate 342.

The avoidance of the drawing of secondary combustion air into reaction contact with the mixed gaseous fuel and combustion air downstream of the burner plate 342 can be simply achieved through the utilization of a burner housing wherein the shoulder portion 344 free of open secondary air inlet apertures. For example, the burner housing may be simply be configured without secondary air inlet apertures. Alternatively, the burner housing may include secondary air inlet apertures, such as the apertures 246 in the above-described embodiment, but such apertures may appropriately covered, blocked or plugged to avoid or prevent the passage of secondary combustion air therethrough and such as may otherwise be drawn into reaction contact with the mixed gaseous fuel and combustion air downstream of the burner plate 342.

Figure 26:
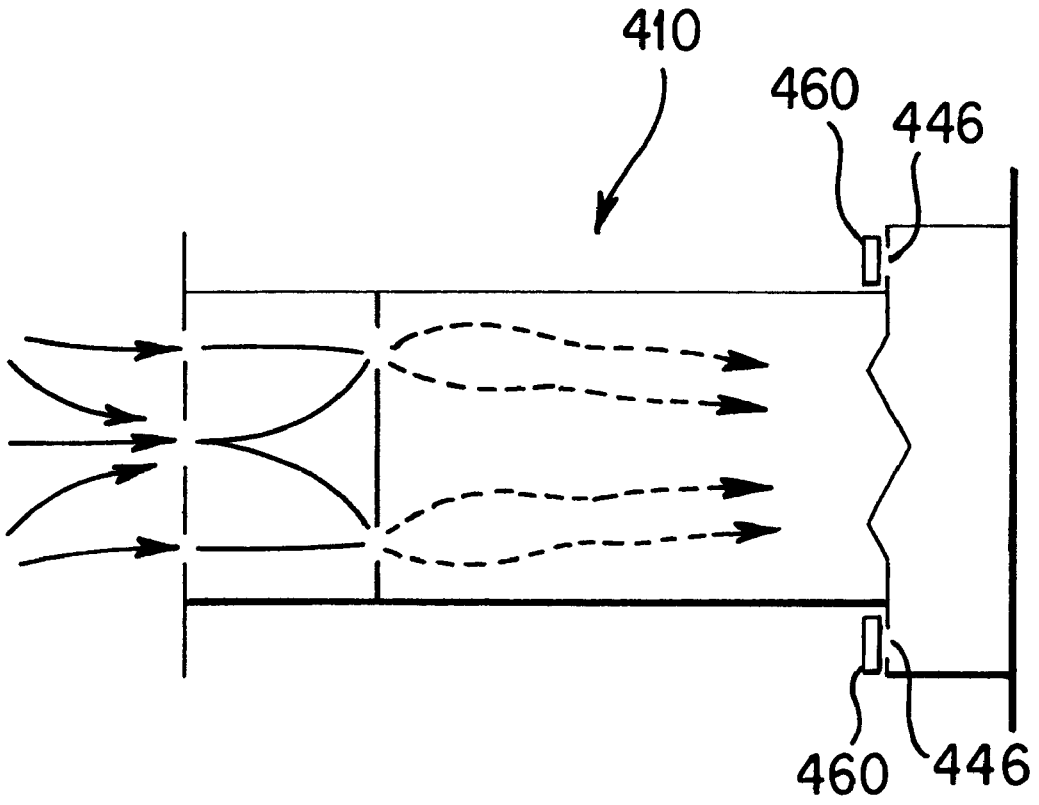
FIG. 26 is an end elevation, similar to that shown in FIG. 11, of a burner plenum configuration in accordance with an alternative embodiment of the invention.

FIG. 26 illustrates one such burner plenum configuration 410 generally similar to the burner plenum configuration 210 shown in FIG. 21 and described above with, however, secondary air inlet apertures 446 appropriately covered, blocked or plugged such as shown schematically by means of cover element 460.

Thus, the invention provides a burner housing which is relatively easily adaptable for use in a fully premixed or a partially premixed burner configuration. As will be appreciated, such adaptability of a single housing design can desirably simplify manufacture, production and supply. For example, such burner housings in accordance with the invention can be manufacture or produced with the drilling or the otherwise formation of secondary air inlet apertures in those burner housings adapted for partially premixed burner configurations being done as a secondary manufacture or production step. Alternatively, such burner housings in accordance with the invention can be manufacture or produced such as to include such secondary air inlet apertures with those of such housings to be used in fully premixed burner configuration having such secondary air inlet apertures appropriately covered, blocked or plugged to avoid or prevent the passage of secondary combustion air therethrough.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A burner housing, for use with a burner apparatus, configured to form a plenum for receiving combustion air and gaseous fuel, for mixing same for delivery to a desired location for ignition of the mixed gaseous fuel and combustion air, toward promoting the production of a stabilized flame for providing heat to be transferred to a location remote from the burner apparatus, the burner housing comprising:

a side wall, at least in part defining an interior volume;

an inlet plate, connected to the side wall, at one end thereof; and a target plate, longitudinally spaced from the inlet plate, defining, within the interior volume, an introduction zone for the introduction of combustion air and gaseous fuel to the interior volume and, adjacent the introduction zone, a mixing zone for the mixing of the gaseous fuel and combustion air, wherein the introduction zone and the mixing zone have a substantially constant width and a substantially constant thickness, the inlet plate having means for enabling injection of gaseous fuel into the introduction zone, the inlet plate further having means for enabling ambient air to be drawn into the introduction zone by a suction source disposed downstream of the plenum, the target plate having means for enabling passage of combustion air and gaseous fuel from the introduction zone into the mixing zone to form a combustible mixture of combustion air and gaseous fuel.

2. The burner housing of claim 1 additionally comprising a burner plate holding section adapted to hold a burner plate adjacent an end of the side wall opposite the inlet plate.

3. The burner housing of claim 2 wherein the burner plate holding section comprises a shoulder portion adapted to be joined in substantial circumferential surrounding relationship with a burner plate and wherein the shoulder portion includes a plurality of air inlet apertures for enabling ambient secondary air to be drawn into reaction contact with the mixed gaseous fuel and combustion air.

4. A burner assembly comprising the burner housing of claim 1 wherein the side wall is operably configured in association with a burner plate, having at least one flame holder region, for directing mixed gaseous fuel and combustion air to the at least one flame holder region.

5. The burner assembly of claim 4 additionally comprising means for enabling ambient secondary air to be drawn into reaction contact with the mixed gaseous fuel and combustion air at the burner plate.

6. The burner assembly of claim 5 wherein the means for enabling ambient secondary air to be drawn into reaction contact with the mixed gaseous fuel and combustion air at the burner plate comprises a plurality of air inlet apertures circumferentially spaced about the at least one flame holder region.

7. The burner assembly of claim 6 wherein the burner housing includes a shoulder portion in substantially circumferential surrounding relationship with the burner plate and wherein the air inlet apertures are formed in the shoulder portion of the burner housing.

8. The burner assembly of claim 4 wherein the introduction zone and the mixing zone have a substantially constant width and a substantially constant thickness.

9. A burner assembly comprising:

a burner housing configured to form a plenum for receiving combustion air and gaseous fuel, for mixing same for delivery to a desired location for ignition of the mixed gaseous fuel and combustion air, toward promoting the production of a stabilized flame for providing heat to be transferred to a location remote from the burner assembly, and a burner plate operably configured in association with the burner housing, the burner housing including:

a side wall, at least in part defining an interior volume;

an inlet plate, connected to the side wall, at one end thereof, a target plate, longitudinally spaced from the inlet plate, defining, within the interior volume, an introduction zone for the introduction of combustion air and gaseous fuel to the interior volume and, adjacent the introduction zone, a mixing zone for the mixing of the gaseous fuel and combustion air, and a burner plate holding section adapted to hold the burner plate adjacent an end of the side wall opposite the inlet plate, the inlet plate having means for enabling injection of gaseous fuel into the introduction zone, the inlet plate further having means for enabling ambient air to be drawn into the introduction zone by a suction source disposed downstream of the plenum, the target plate having means for enabling passage of combustion air and gaseous fuel from the introduction zone into the mixing zone to form a combustible mixture of combustion air and gaseous fuel, wherein the burner plate includes at least one flame holder region and wherein the side wall of the burner housing defining the mixing zone is operably configured in association with a burner plate, for directing mixed gaseous fuel and combustion air to the at least one flame holder region; and wherein the burner assembly additionally comprises means for enabling ambient secondary air to be drawn into reaction contact with the mixed gaseous fuel and combustion air at the burner plate.

10. The burner assembly of claim 9 wherein the means for enabling ambient secondary air to be drawn into reaction contact with the mixed gaseous fuel and combustion air at the burner plate comprises a plurality of air inlet apertures circumferentially spaced about the at least one flame holder region.

11. The burner assembly of claim 10 wherein the burner housing includes a shoulder portion in substantially circumferential surrounding relationship with the burner plate and wherein the air inlet apertures are formed in the shoulder portion of the burner housing.

12. The burner assembly of claim 11 wherein the introduction zone and the mixing zone have a substantially constant width and a substantially constant thickness.

13. A burner housing, for use with a burner apparatus, configured to form a plenum for receiving combustion air and gaseous fuel, for mixing same for delivery to a desired location for ignition of the mixed gaseous fuel and combustion air, toward promoting the production of a stabilized flame for providing heat to be transferred to a location remote from the burner apparatus, the burner housing adapted to hold a burner plate and comprising:

a side wall, at least in part defining an interior volume;

an inlet plate, connected to the side wall, at one end thereof; and a target plate, longitudinally spaced from the inlet plate, defining, within the interior volume, an introduction zone for the introduction of combustion air and gaseous fuel to the interior volume and, adjacent the introduction zone, a mixing zone for the mixing of the gaseous fuel and combustion air, the inlet plate having means for enabling injection of gaseous fuel into the introduction zone, the inlet plate further having means for enabling ambient air to be drawn into the introduction zone by a suction source disposed downstream of the plenum, the target plate having means for enabling passage of combustion air and gaseous fuel from the introduction zone into the mixing zone to form a combustible mixture of combustion air and gaseous fuel, the burner housing configured to selectively alternatively operate in a fully premixed mode of operation wherein substantially all combustion air is introduced through the introduction zone and in a partial premixed mode of operation wherein secondary combustion air is drawn into reaction contact with the mixed gaseous fuel and combustion air downstream of the burner plate.

* * * * *